US009046833B2

(12) United States Patent
Seki et al.

(10) Patent No.: US 9,046,833 B2
(45) Date of Patent: Jun. 2, 2015

(54) FIXING DEVICE AND IMAGE FORMING APPARATUS INCORPORATING SAME

(71) Applicants: Takayuki Seki, Kanagawa (JP); Yuji Arai, Kanagawa (JP); Yoshiki Yamaguchi, Kanagawa (JP); Shuntaroh Tamaki, Kanagawa (JP); Yutaka Ikebuchi, Kanagawa (JP); Kazuya Saito, Kanagawa (JP); Naoki Iwaya, Tokyo (JP); Toshihiko Shimokawa, Kanagawa (JP)

(72) Inventors: Takayuki Seki, Kanagawa (JP); Yuji Arai, Kanagawa (JP); Yoshiki Yamaguchi, Kanagawa (JP); Shuntaroh Tamaki, Kanagawa (JP); Yutaka Ikebuchi, Kanagawa (JP); Kazuya Saito, Kanagawa (JP); Naoki Iwaya, Tokyo (JP); Toshihiko Shimokawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/024,931

(22) Filed: Sep. 12, 2013

(65) Prior Publication Data

US 2014/0079455 A1 Mar. 20, 2014

(30) Foreign Application Priority Data

| | | |
|---|---|---|
| Sep. 14, 2012 | (JP) | 2012-203283 |
| Sep. 14, 2012 | (JP) | 2012-203290 |
| May 10, 2013 | (JP) | 2013-100228 |
| May 10, 2013 | (JP) | 2013-100229 |

(51) Int. Cl.
*G03G 15/20* (2006.01)

(52) U.S. Cl.
CPC ..... *G03G 15/2017* (2013.01); *G03G 15/2053* (2013.01); *G03G 2215/0132* (2013.01); *G03G 2215/2035* (2013.01)

(58) Field of Classification Search
USPC ..... 399/329
See application file for complete search history.

(56) References Cited

U.S. PATENT DOCUMENTS

2010/0067929 A1 3/2010 Seki

FOREIGN PATENT DOCUMENTS

| | | | | |
|---|---|---|---|---|
| JP | 2004-258484 | | 9/2004 | |
| JP | 2008-139779 | | 6/2008 | |
| JP | 2010-066583 | | 3/2010 | |
| JP | 2011-047995 | | 3/2011 | |
| JP | 2011-047995 A | * | 3/2011 | ..... G03G 15/20 |
| JP | 2012-145720 | | 8/2012 | |

* cited by examiner

*Primary Examiner* — Clayton E Laballe
*Assistant Examiner* — Jas Sanghera
(74) *Attorney, Agent, or Firm* — Harness, Dickey & Pierce, P.L.C.

(57) ABSTRACT

A fixing device included in an image forming apparatus includes a fixing rotary body, a heater disposed opposite the fixing rotary body, an opposed body contacting an outer circumferential surface of the fixing rotary body, a reflector disposed opposite the heater, and a heat shield disposed between the heater and the fixing rotary body and includes a shield portion to shield heat radiated from the heater to the fixing rotary body. Heat reflectance of at least a surface of the shield portion where the heat shield faces the heater is set to a value smaller than heat reflectance on a surface of the reflector opposite and facing the heater. Also, heat absorptance of at least a surface of the shield portion where the heat shield faces the heater is set to a value greater than heat absorptance on a surface of the reflector opposite and facing the heater.

20 Claims, 13 Drawing Sheets

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2012-203283, filed on Sep. 14, 2012, 2012-203290, filed on Sep. 14, 2012, 2013-100228, filed on May 10, 2013, and 2013-100229, filed on May 10, 2013 in the Japan Patent Office, the entire disclosures of which are hereby incorporated by reference herein.

BACKGROUND

1. Technical Field

Embodiments of the present invention relate to a fixing device and an image forming apparatus, and more particularly, to a fixing device for fixing an image on a recording medium and an image forming apparatus incorporating the fixing device.

2. Related Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image to the recording medium, thus forming the image on the recording medium.

Such fixing device may include a fixing rotary body heated by a heater and an opposed body contacting the fixing rotary body to form a nip therebetween through which a recording medium bearing a toner image is conveyed. As the fixing rotary body and the opposed body rotate and convey the recording medium bearing the toner image through the nip, the fixing rotary body heated to a predetermined fixing temperature and the opposed body together heat and melt toner of the toner image, thus fixing the toner image to the recording medium.

Since the recording medium passing through the nip draws heat from the fixing rotary body, a temperature sensor detects the temperature of the fixing rotary body to maintain the fixing rotary body at a desired temperature. However, at each lateral end of the fixing rotary body in an axial direction thereof, the recording medium is not conveyed over the fixing rotary body, and therefore the recording medium does not draw heat from the fixing rotary body. Accordingly, after multiple recording media are conveyed through the nip continuously, a non-conveyance span provided at each lateral end of the fixing rotary body may overheat.

To address this circumstance, Japanese Patent Application Publication No. JP-2008-139779-A discloses a surface heating type fixing device that incorporates a shield member to shield the non-conveyance span of the fixing roller from the heater, thus preventing overheating of the fixing roller. The surface heating type fixing device includes a reflector having a slit to wrap around a halogen heater and be disposed such that the slit faces the fixing roller. The shield member is inserted into and removed from the slit of the reflector to the fixing roller within a light emitting path in which heat is emitted toward the fixing roller.

SUMMARY

The present invention provides a fixing device including a fixing rotary body rotatable in a predetermined direction of rotation, a heater disposed opposite and heating the fixing rotary body, an opposed body contacting the fixing rotary body to form a nip therebetween through which a recording medium is conveyed, a reflector disposed opposite the heater, and a heat shield disposed between the heater and the fixing rotary body and includes a shield portion to shield heat radiated from the heater to the fixing rotary body. Heat reflectance of at least a surface of the shield portion where the heat shield faces the heater is set to a value smaller than heat reflectance on a surface of the reflector opposite and facing the heater.

Further, the present invention provides an image forming apparatus including the above-described fixing device.

The present invention provides a fixing device including a fixing rotary body rotatable in a predetermined direction of rotation, a heater disposed opposite and heating the fixing rotary body, an opposed body contacting the fixing rotary body to form a nip therebetween through which a recording medium is conveyed, a reflector disposed opposite the heater, and a heat shield disposed between the heater and the fixing rotary body and includes a shield portion to shield heat radiated from the heater to the fixing rotary body. Heat absorptance of at least a surface of the shield portion where the heat shield faces the heater is set to a value greater than heat absorptance on a surface of the reflector opposite and facing the heater.

Further, the present invention provides an image forming apparatus including the above-described fixing device.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
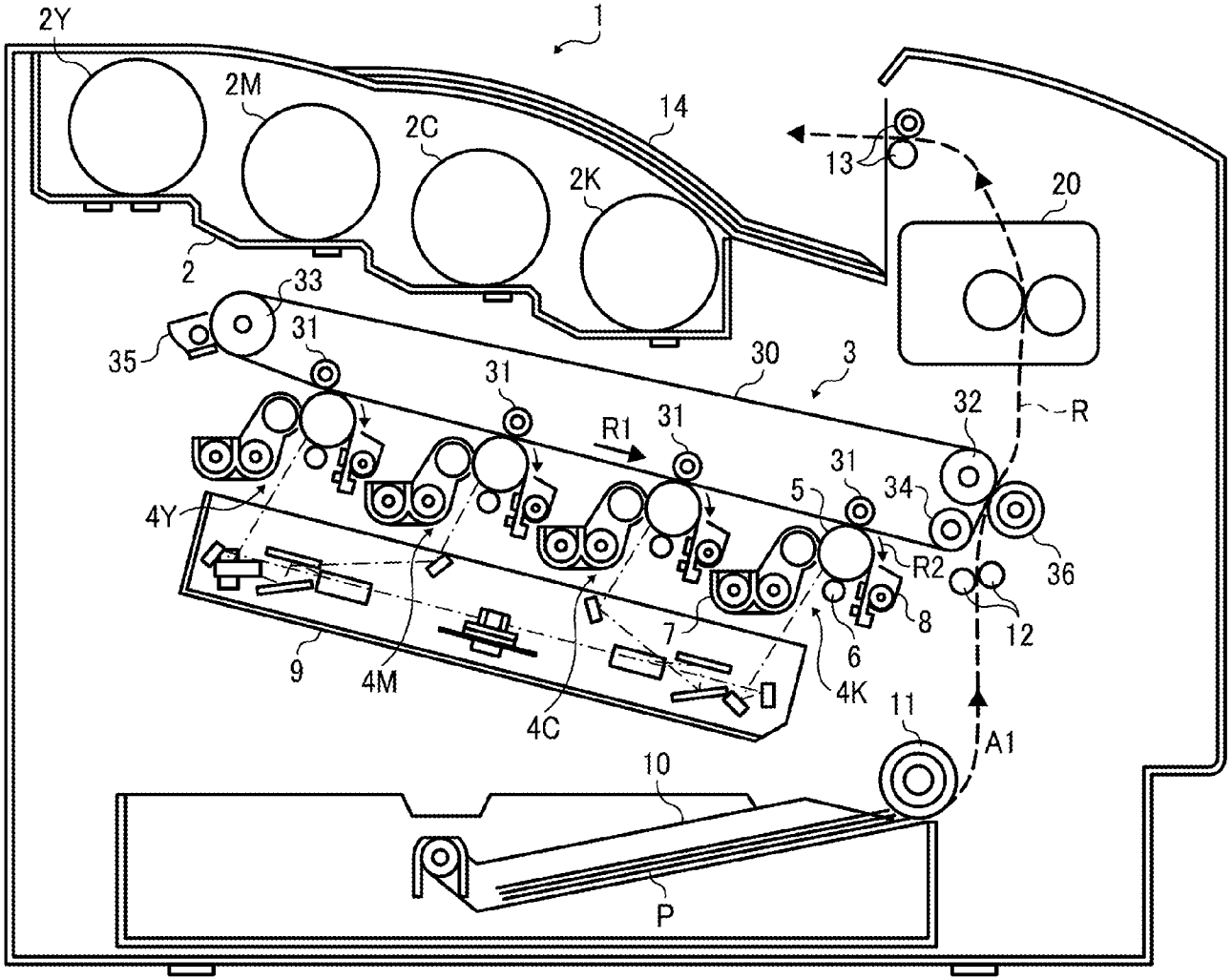
FIG. 1 is a schematic vertical sectional view of an image forming apparatus according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, in particular to FIG. 1, an image forming apparatus 1 according to an embodiment of the present invention is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to the present embodiment, the image forming apparatus 1 is a color laser printer that forms color and monochrome toner images on recording media by electrophotography.

As illustrated in FIG. 1, the image forming apparatus 1 includes four image forming devices 4Y, 4M, 4C, and 4K disposed at a center portion thereof. Although the image forming devices 4Y, 4M, 4C, and 4K contain yellow, magenta, cyan, and black developers (e.g., toners) that form yellow, magenta, cyan, and black toner images, respectively, resulting in a color toner image, units and components included therein have an identical structure.

Specifically, each of the image forming devices 4Y, 4M, 4C, and 4K includes a drum-shaped photoconductor 5 functioning as an image carrier that carries an electrostatic latent image and a resultant toner image; a charger 6 that uniformly charges an outer circumferential surface of the photoconductor 5; a development device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 1, reference numerals are assigned to the photoconductor 5, the charger 6, the development device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent transmitted from an external device such as a client computer.

Above the image forming devices 4Y, 4M, 4C, and 4K is a transfer device 3. For example, the transfer device 3 includes an intermediate transfer belt 30 functioning as an intermediate transfer member, four primary transfer rollers 31 functioning as primary transfer members, a secondary transfer roller 36 functioning as a secondary transfer member, a secondary transfer backup roller 32, a cleaning backup roller 33, a tension roller 34, and a belt cleaner 35.

The intermediate transfer belt 30 is an endless belt stretched across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 in a rotation direction R1 by friction therebetween.

The four primary transfer rollers 31 sandwich the intermediate transfer belt 30 together with the four photoconductors 5, respectively, forming four primary transfer nips between the intermediate transfer belt 30 and the photoconductors 5. The primary transfer rollers 31 are connected to a power supply that applies a predetermined direct current (DC) voltage and/or alternating current (AC) voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies a predetermined direct current (DC) voltage and/or alternating current (AC) voltage thereto.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle holder 2 disposed in an upper portion of the image forming apparatus 1 accommodates four toner bottles 2Y, 2M, 2C, and 2K detachably attached thereto to contain and supply fresh yellow, magenta, cyan, and black toners to the development devices 7 of the image forming devices 4Y, 4M, 4C, and 4K, respectively. For example, the fresh yellow, magenta, cyan, and black toners are supplied from the toner bottles 2Y, 2M, 2C, and 2K to the development devices 7 through toner supply tubes interposed between the toner bottles 2Y, 2M, 2C, and 2K and the development devices 7, respectively.

In a lower portion of the image forming apparatus 1 is a paper tray 10 that loads recording media P (e.g., sheets) and a feed roller 11 that picks up and feeds a recording medium P from the paper tray 10 toward the secondary transfer nip formed between the secondary transfer roller 36 and the intermediate transfer belt 30. The recording media P may be thick paper, postcards, envelopes, plain paper, thin paper, coated paper, art paper, tracing paper, OHP (overhead projector) transparencies, OHP film sheets, and the like. Additionally, a bypass tray that loads postcards, envelopes, OHP transparencies, OHP film sheets, and the like may be attached to the image forming apparatus 1.

A conveyance path R extends from the feed roller 11 to an output roller pair 13 to convey the recording medium P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a recording medium conveyance direction A1. The registration roller pair 12 functioning as a timing roller pair feeds the recording medium P conveyed from the feed roller 11 toward the secondary transfer nip.

The conveyance path R is further provided with a fixing device 20 located above the secondary transfer nip, that is, downstream from the secondary transfer nip in the recording medium conveyance direction A1. The fixing device 20 fixes a toner image transferred from the intermediate transfer belt 30 onto the recording medium P conveyed from the secondary transfer nip. The conveyance path R is further provided with the output roller pair 13 located above the fixing device 20, that is, downstream from the fixing device 20 in the recording medium conveyance direction A1. The output roller pair 13 discharges the recording medium P bearing the fixed toner image onto the outside of the image forming apparatus 1, that is, an output tray 14 disposed atop the image forming apparatus 1. The output tray 14 stocks the recording medium P discharged by the output roller pair 13.

With reference to FIG. 1, a description is given of an image forming operation of the image forming apparatus 1 having the structure described above to form a color toner image on a recording medium P.

As a print job starts, a driver drives and rotates the photoconductors 5 of the image forming devices 4Y, 4M, 4C, and 4K, respectively, clockwise in FIG. 1 in a rotation direction R2. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data contained in image data sent from the external device, respectively, thus forming electrostatic latent images thereon. The development devices 7 supply yellow, magenta, cyan, and black toners to the electrostatic latent images formed on the photoconductors 5, visualizing the electrostatic latent images into yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction R1 by friction therebetween. The power supply applies a constant voltage or a constant current control voltage having a polarity opposite a polarity of the toner to the primary transfer rollers 31, creating a transfer electric field at each primary transfer nip formed between the photoconductor 5 and the primary transfer roller 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a color toner image is formed on the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a recording medium P from the paper tray 10 toward the registration roller pair 12 in the conveyance path R. As the recording medium P comes into contact with the registration roller pair 12, the registration roller pair 12 that interrupts its rotation temporarily halts the recording medium P.

Thereafter, the registration roller pair 12 resumes its rotation and conveys the recording medium P to the secondary transfer nip at a time when the color toner image formed on the intermediate transfer belt 30 reaches the secondary transfer nip. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip. The transfer electric field secondarily transfers the yellow, magenta, cyan, and black toner images constituting the color toner image formed on the intermediate transfer belt 30 onto the recording medium P collectively. After the secondary transfer of the color toner image from the intermediate transfer belt 30 onto the recording medium P, the belt cleaner 35 removes residual toner failed to be transferred onto the recording medium P and therefore remaining on the intermediate transfer belt 30 therefrom. The removed toner is conveyed and collected into the waste toner container.

Thereafter, the recording medium P bearing the color toner image is conveyed to the fixing device 20 that fixes the color toner image on the recording medium P. Then, the recording medium P bearing the fixed color toner image is discharged by the output roller pair 13 onto the output tray 14.

The above describes the image forming operation of the image forming apparatus 1 to form the color toner image on the recording medium P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
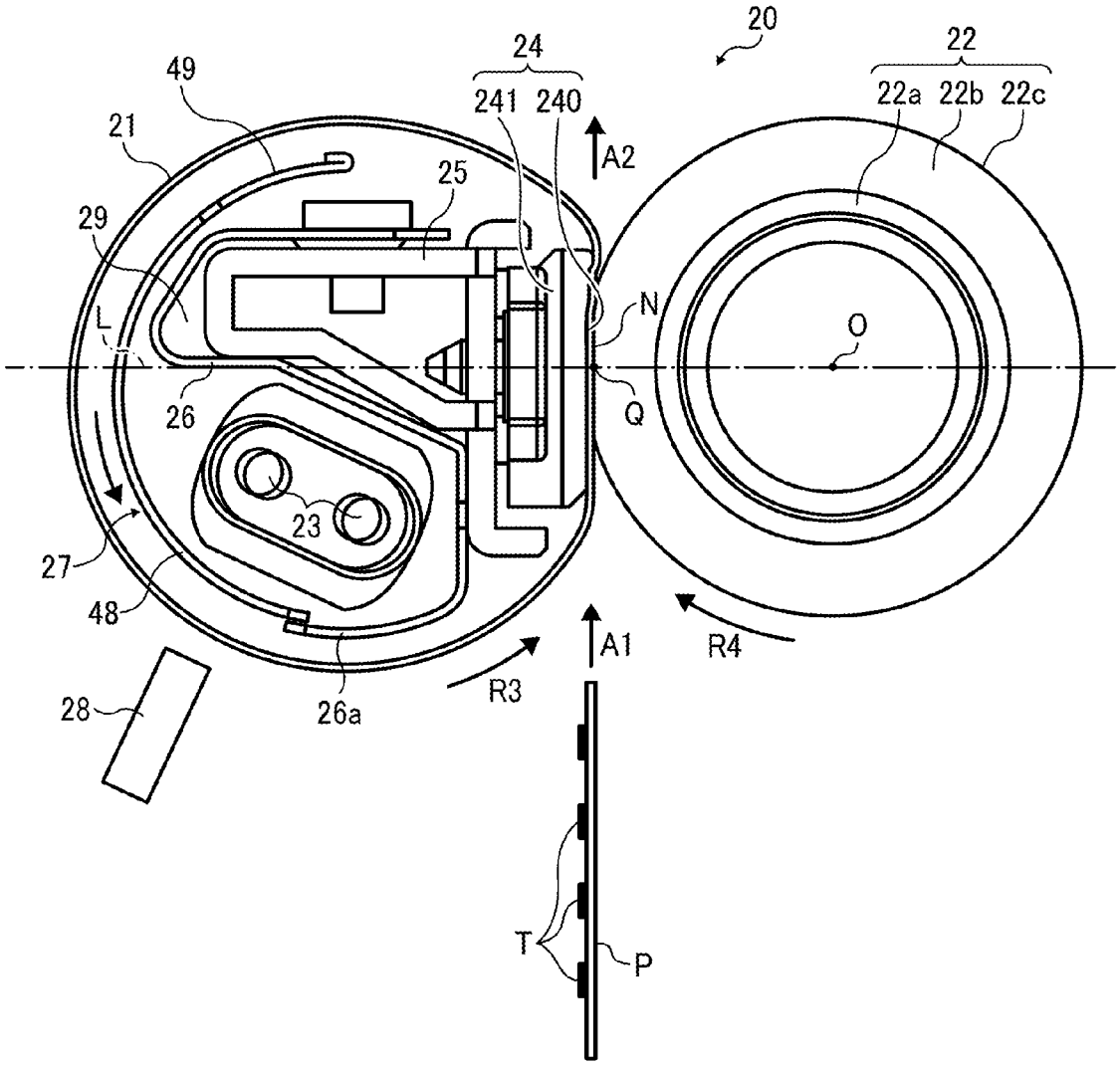
FIG. 2 is a vertical sectional view of a fixing device incorporated in the image forming apparatus shown in FIG. 1 illustrating a heat shield incorporated therein located at a shield position.
Figure 3:
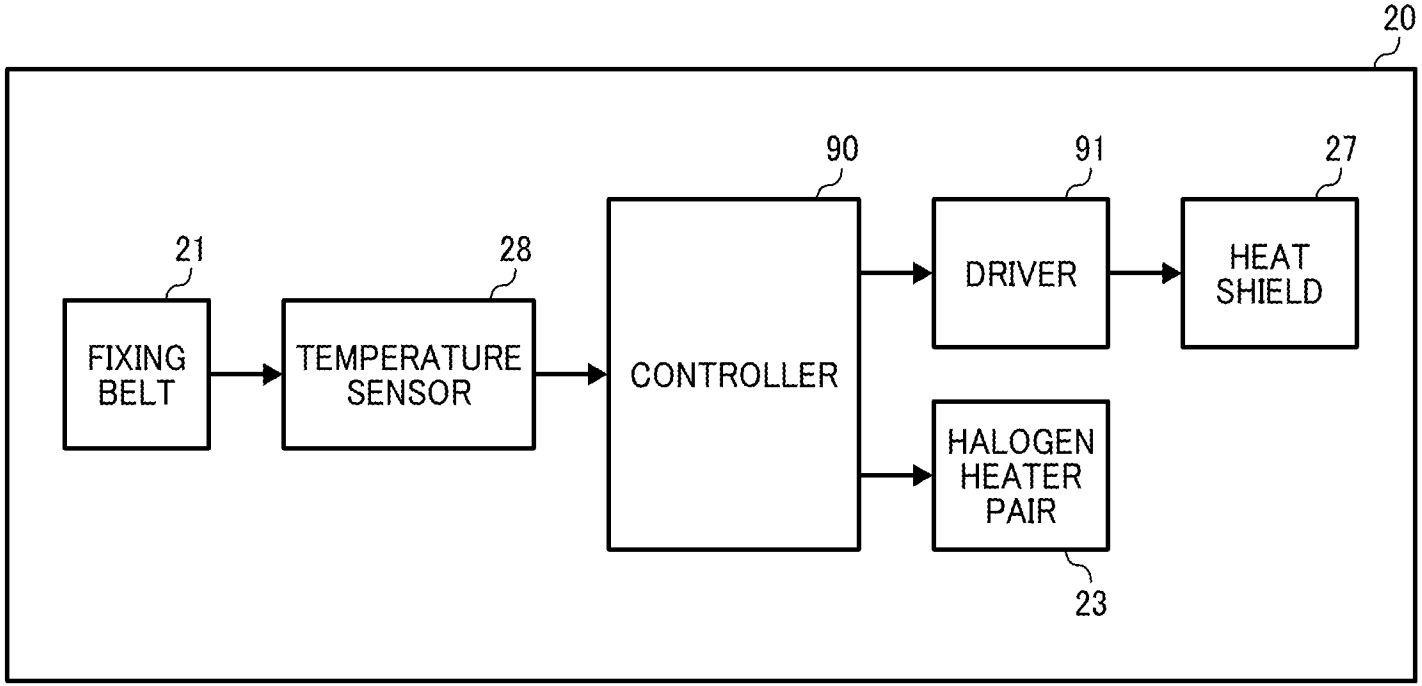
FIG. 3 is a block diagram of the fixing device illustrated in FIG. 2.

With reference to FIGS. 2 and 3, a description is provided of a construction of the fixing device 20 incorporated in the image forming apparatus 1 described above.

FIG. 2 is a vertical sectional view of the fixing device 20. FIG. 3 is a block diagram of the fixing device 20.

As shown in FIG. 2, the fixing device 20 (e.g., a fuser) includes a fixing belt 21 functioning as a fixing rotary body or an endless belt formed into a loop and rotatable in a rotation direction R3; a pressing roller 22 functioning as an opposed body disposed opposite an outer circumferential surface of the fixing belt 21 and rotatable in a rotation direction R4 counter to the rotation direction R3 of the fixing belt 21; a halogen heater pair 23 functioning as a heater disposed inside the loop formed by the fixing belt 21 and heating the fixing belt 21; a nip formation assembly 24 disposed inside the loop formed by the fixing belt 21 and pressing against the pressing roller 22 via the fixing belt 21 to form a fixing nip N between the fixing belt 21 and the pressing roller 22; a stay 25 functioning as a support disposed inside the loop formed by the fixing belt 21 and contacting and supporting the nip formation assembly 24; a reflector 26 disposed inside the loop formed by the fixing belt 21 and reflecting light radiated from the halogen heater pair 23 thereto toward the fixing belt 21; a heat shield 27 interposed between the halogen heater pair 23 and the fixing belt 21 to shield the fixing belt 21 from light radiated from the halogen heater pair 23; a temperature sensor 28 functioning as a temperature detector disposed opposite the outer circumferential surface of the fixing belt 21 and detecting the temperature of the fixing belt 21; and a controller 90 depicted in FIG. 3 operatively connected to the temperature sensor 28 and the heat shield 27 to control the rotation angle of the heat shield 27.

A detailed description is now given of a construction of the fixing belt 21.

The fixing belt 21 is a thin, flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (FIFE), or the like. Alternatively, an elastic layer made of rubber such as silicone rubber, silicone rubber foam, and fluoro rubber may be interposed between the base layer and the release layer.

If the fixing belt 21 does not incorporate the elastic layer, the fixing belt 21 has a decreased thermal capacity that improves fixing performance of being heated to a predetermined fixing temperature quickly. However, as the pressing roller 22 and the fixing belt 21 sandwich and press a toner image T on a recording medium P passing through the fixing nip N, slight surface asperities of the fixing belt 21 may be transferred onto the toner image T on the recording medium P, resulting in variation in gloss of the solid toner image T. To address this problem, it is preferable that the fixing belt 21 incorporates the elastic layer having a thickness not smaller than about 80 micrometers. The elastic layer having the thickness not smaller than about 80 micrometers elastically deforms to absorb slight surface asperities of the fixing belt 21, preventing variation in gloss of the toner image T on the recording medium P.

According to the present embodiment, the fixing belt 21 is designed to be thin and have a reduced loop diameter so as to decrease the thermal capacity thereof. For example, the fixing belt 21 is constructed of the base layer having a thickness in a range of from about 20 micrometers to about 50 micrometers;

the elastic layer having a thickness in a range of from about 80 micrometers to about 300 micrometers; and the release layer having a thickness in a range of from about 3 micrometers to about 50 micrometers. Thus, the fixing belt 21 has a total thickness not greater than about 1 mm. A loop diameter of the fixing belt 21 is in a range of from about 20 mm to about 40 mm. In order to decrease the thermal capacity of the fixing belt 21 further, the fixing belt 21 may have a total thickness not greater than about 0.20 mm and preferably not greater than about 0.16 mm. Additionally, the loop diameter of the fixing belt 21 may not be greater than about 30 mm.

A detailed description is now given of a construction of the pressing roller 22.

The pressing roller 22 is constructed of a metal core 22*a*; an elastic layer 22*b* coating the metal core 22*a* and made of silicone rubber foam, silicone rubber, fluoro rubber, or the like; and a release layer 22*c* coating the elastic layer 22*b* and made of PFA, PTFE, or the like. A pressurization assembly presses the pressing roller 22 against the nip formation assembly 24 via the fixing belt 21. Thus, the pressing roller 22 pressingly contacting the fixing belt 21 deforms the elastic layer 22*b* of the pressing roller 22 at the fixing nip N formed between the pressing roller 22 and the fixing belt 21, thus creating the fixing nip N having a predetermined length in the recording medium conveyance direction A1. According to the present embodiment, the pressing roller 22 is pressed against the fixing belt 21. Alternatively, the pressing roller 22 may merely contact the fixing belt 21 with no pressure therebetween.

A driver (e.g., a motor) disposed inside the image forming apparatus 1 depicted in FIG. 1 drives and rotates the pressing roller 22. As the driver drives and rotates the pressing roller 22, a driving force of the driver is transmitted from the pressing roller 22 to the fixing belt 21 at the fixing nip N, thus rotating the fixing belt 21 by friction between the pressing roller 22 and the fixing belt 21.

According to the present embodiment, the pressing roller 22 is a solid roller. Alternatively, the pressing roller 22 may be a hollow roller. In this case, a heater such as a halogen heater may be disposed inside the hollow roller. Further, the elastic layer 22*b* may be made of solid rubber. Alternatively, if no heater is disposed inside the pressing roller 22, the elastic layer 22*b* may be made of sponge rubber. The sponge rubber is more preferable than the solid rubber because it has an increased insulation that draws less heat from the fixing belt 21.

The halogen heater pair 23 is disposed inside the loop formed by the fixing belt 21 and upstream from the fixing nip N in the recording medium conveyance direction A1. For example, the halogen heater pair 23 is disposed lower than and upstream from a hypothetical line L passing through a center Q of the fixing nip N in the recording medium conveyance direction A1 and an axis 0 of the pressing roller 22 in FIG. 2. The power supply disposed inside the image forming apparatus 1 supplies power to the halogen heater pair 23 so that the halogen heater pair 23 heats the fixing belt 21.

The controller 90 (e.g., a processor), that is, a central processing unit (CPU) provided with a random-access memory (RAM) and a read-only memory (ROM), for example, operatively connected to the halogen heater pair 23 and the temperature sensor 28 controls the halogen heater pair 23 based on the temperature of the fixing belt 21 detected by the temperature sensor 28 so as to adjust the temperature of the fixing belt 21 to a desired fixing temperature. It is to be noted that, instead of the temperature sensor 28 that detects the temperature of the fixing belt 21, another temperature sensor that detects the temperature of the pressing roller 22. The controller 90 may be operatively connected to the temperature sensor to estimate the temperature of the fixing belt 21 based on the temperature of the pressing roller 22 detected by the temperature sensor.

As shown in FIG. 2, according to the present embodiment, two halogen heaters constituting the halogen heater pair 23 are disposed inside the loop formed by the fixing belt 21. Alternatively, one halogen heater or three or more halogen heaters may be disposed inside the loop formed by the fixing belt 21 according to the sizes of recording media P available in the image forming apparatus 1. Alternatively, instead of the halogen heater pair 23, a resistance heat generator, a carbon heater, or the like may be employed as a heater that heats the fixing belt 21 by radiation heat.

A detailed description is now given of a construction of the nip formation assembly 24.

The nip formation assembly 24 includes a base pad 241 and a slide sheet 240 (e.g., a low-friction sheet) covering an outer surface of the base pad 241. The slide sheet 240 covers an opposed face of the base pad 241 disposed opposite the fixing belt 21.

The base pad 241 is made of a heat resistant material resistant against temperatures of 200 degrees centigrade or more to prevent thermal deformation of the nip formation assembly 24 by temperatures in a fixing temperature range desirable to fix the toner image T on the recording medium P, thus retaining the shape of the fixing nip N and quality of the toner image T formed on the recording medium P. For example, the base pad 241 is made of general heat resistant resin such as polyether sulfone (PES), polyphenylene sulfide (PPS), liquid crystal polymer (LCP), polyether nitrile (PEN), polyamide imide (PAI), polyether ether ketone (PEEK), or the like. Alternatively, the base pad 241 may be made of metal, ceramic, or the like.

The base pad 241 is mounted on and supported by the stay 25. Accordingly, even if the base pad 241 receives pressure from the pressing roller 22, the base pad 241 is not bent by the pressure and therefore produces a uniform nip width throughout the entire width of the pressing roller 22 in the axial direction thereof. The stay 25 is made of metal having an increased mechanical strength, such as stainless steel and iron, to prevent bending of the nip formation assembly 24.

A detailed description is now given of a construction of the reflector 26.

The reflector 26 is mounted on and supported by the stay 25 and disposed opposite the halogen heater pair 23. The reflector 26 reflects light or heat radiated from the halogen heater pair 23 thereto onto the fixing belt 21, suppressing conduction of heat from the halogen heater pair 23 to the stay 25. Thus, the reflector 26 facilitates efficient heating of the fixing belt 21, saving energy.

Figure 4:
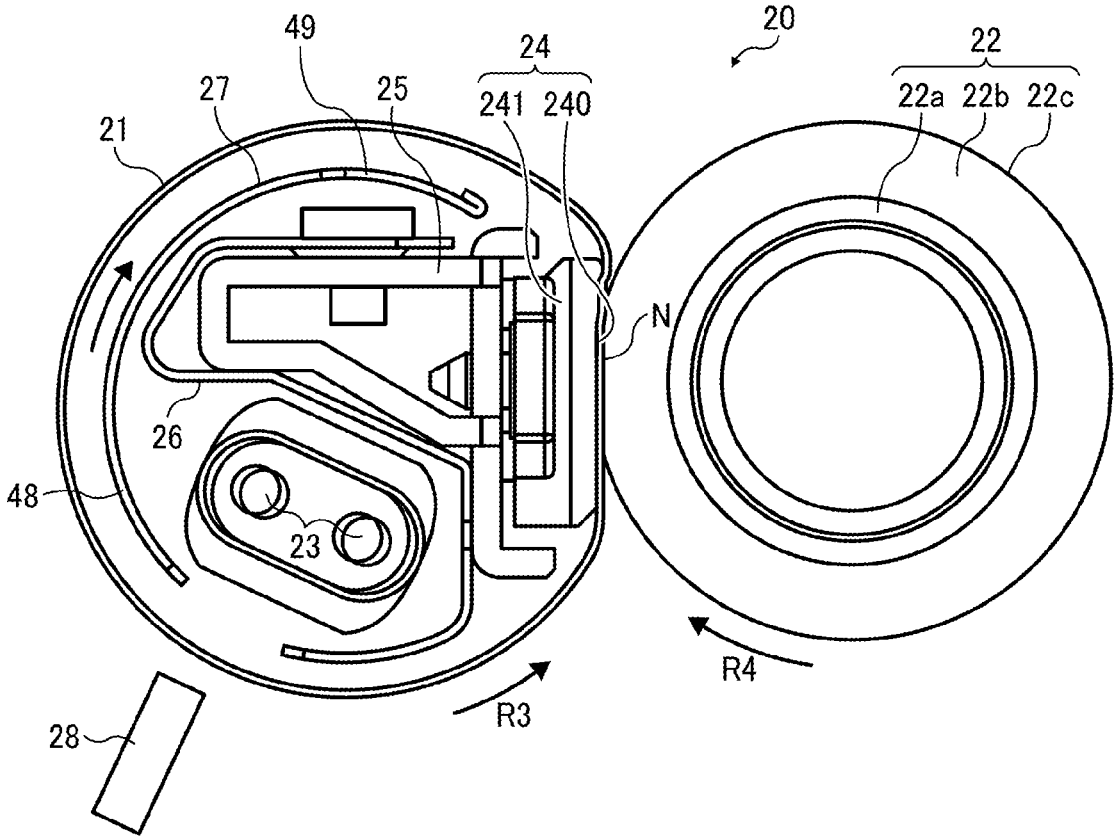
FIG. 4 is a vertical sectional view of the fixing device shown in FIG. 2 illustrating the heat shield located at a retracted position.

With reference to FIGS. 2 and 4, a detailed description is now given of a configuration of the heat shield 27.

FIG. 4 is a vertical sectional view of the fixing device 20. For example, the heat shield 27 is a metal plate, having a thickness in a range of from about 0.1 mm to about 1.0 mm. The entire heat shield 27 is an arc in cross-section arched along the inner circumferential surface of the fixing belt 21 that is perpendicular to the longitudinal direction of the fixing belt 21. The heat shield 27 is disposed close to the inner circumferential surface of the fixing belt 21 inside the loop formed by the fixing belt 21 and is rotatable in a substantially coaxial direction with the fixing belt 21 without contacting the inner circumferential surface thereof. In the present embodiment, in a region of the fixing belt 21 in the circumferential direction thereof, a circumference of the fixing belt 21 is divided into two sections: a circumferential, direct heating span where a halogen heater pair 23 is disposed opposite and heats the fixing belt 21 directly; and a circumferential, indirect heating span where the halogen heater pair 23 is disposed opposite the fixing belt 21 indirectly via the components other than the heat shield 27, that is, the reflector 26, the stay 25, the nip formation assembly 24, and the like. The heat shield 27 moves to a shield position shown in FIG. 2 where the heat shield 27 is interposed between the halogen heater pair 23 and the fixing belt 21 in the direct heating span to shield the fixing belt 21 from light radiated from the halogen heater pair 23. Conversely, the heat shield 27 moves to a retracted position shown in FIG. 4 where the heat shield 27 retracts from the direct heating span to the indirect heating span and therefore is not interposed between the halogen heater pair 23 and the fixing belt 21. That is, the heat shield 27 is behind the reflector 26 and the stay 25 and therefore disposed opposite the halogen heater pair 23 via the reflector 26 and the stay 25. The heat shield 27 is made of a heat resistant material, for example, metal such as aluminum, iron, and stainless steel or ceramic.

Thus, by moving the heat shield 27 between the retracted position and the shield position, the shield area is increased or decreased (to zero, for example), thereby adjusting the amount of heat supplied by the halogen heater pair 23 to the fixing belt 21. Accordingly, the shield 27 is made of a material having a heat resistance property equal to or greater than 350 degrees Celsius. As long as this condition is met, the heat shield 27 can be formed by a material other than metal, for example, a resin or a ceramic.

Figure 5:
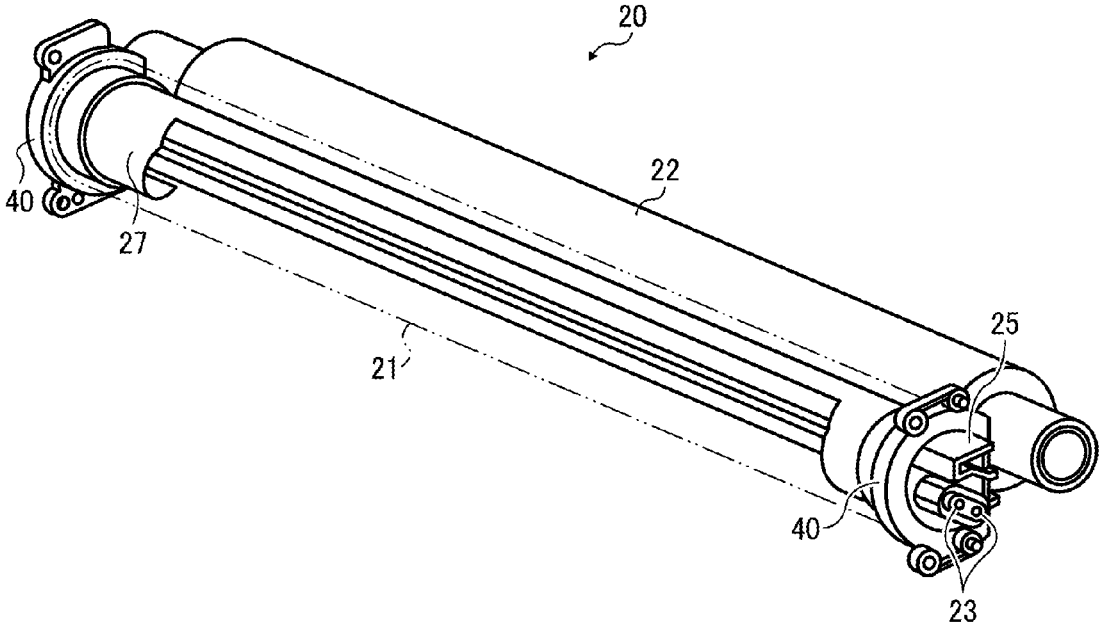
FIG. 5 is a partial perspective view of the fixing device shown in FIG. 4.

With reference to FIG. 5, a description is provided of a configuration of flanges 40 incorporated in the fixing device 20.

FIG. 5 is a partial perspective view of the fixing device 20. As shown in FIG. 5, the flanges 40 functioning as a belt holder are inserted into both lateral ends of the fixing belt 21 in the axial direction thereof, respectively, to rotatably support the fixing belt 21. Both lateral ends of the flanges 40, the halogen heater pair 23, and the stay 25 in the axial direction of the fixing belt 21 are mounted on and supported by a pair of side plates of the fixing device 20, respectively.

Figure 6:
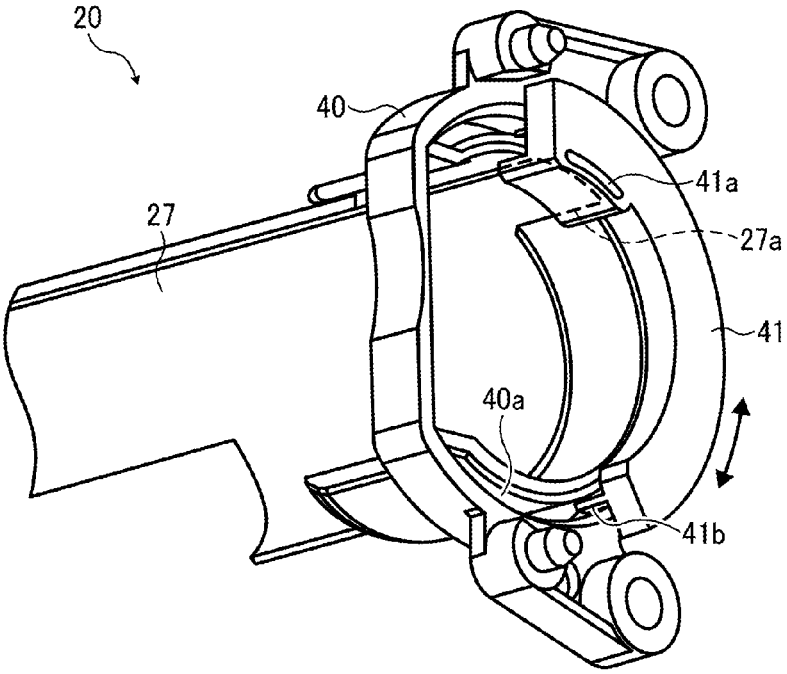
FIG. 6 is a partial perspective view of the fixing device shown in FIG. 2 illustrating one lateral end of the heat shield in an axial direction thereof.

With reference to FIG. 6, a description is provided of a support mechanism that supports the heat shield 27.

FIG. 6 is a partial perspective view of the fixing device 20 illustrating one lateral end of the heat shield 27 in the axial direction of the fixing belt 21. As shown in FIG. 6, the heat shield 27 is supported by an arcuate slider 41 rotatably or slidably attached to the flange 40. For example, a projection 27*a* disposed at each lateral end of the heat shield 27 in the axial direction of the fixing belt 21 is inserted into a hole 41*a* produced in the slider 41. Thus, the heat shield 27 is attached to the slider 41. The slider 41 includes a tab 41*b* projecting inboard in the axial direction of the fixing belt 21 toward the heat shield 27. As the tab 41*b* of the slider 41 is inserted into an arcuate groove 40*a* produced in the flange 40, the slider 41 is slidably movable in the groove 40*a*. Accordingly, the heat shield 27, together with the slider 41, is rotatable or movable in a circumferential direction of the flange 40. The flange 40 and the slider 41 are made of resin.

Although FIG. 6 illustrates the support mechanism that supports the heat shield 27 at one lateral end thereof in the axial direction of the fixing belt 21, another lateral end of the heat shield 27 in the axial direction of the fixing belt 21 is also supported by the support mechanism shown in FIG. 6. Thus, another lateral end of the heat shield 27 is also rotatably or movably supported by the slider 41 slidable in the groove 40*a* of the flange 40.

Figure 7:
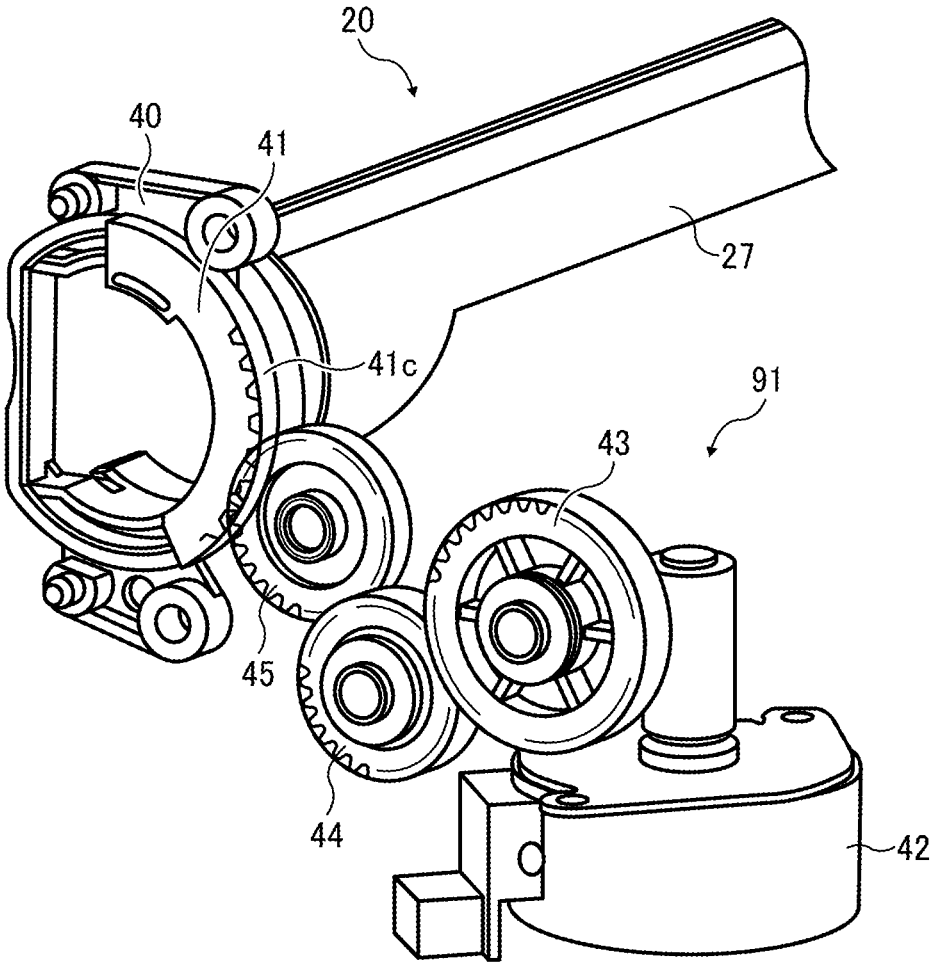
FIG. 7 is a partial perspective view of the fixing device shown in FIG. 2 illustrating a driver incorporated therein.

With reference to FIG. 7, a description is provided of a construction of a driver 91 that drives and rotates the heat shield 27.

FIG. 7 is a partial perspective view of the fixing device 20 illustrating the driver 91. As shown in FIG. 7, the driver 91 includes a motor 42 functioning as a driving source and a plurality of gears 43, 44, and 45 constituting a gear train. The gear 43 functioning as one end of the gear train is connected to the motor 42. The gear 45 functioning as another end of the gear train is connected to a gear 41*c* produced on the slider 41 along a circumferential direction thereof. Accordingly, as the motor 42 is driven, a driving force is transmitted from the motor 42 to the gear 41*c* of the slider 41 through the gear train, that is, the gears 43 to 45, thus rotating the heat shield 27 supported by the slider 41.

Figure 8:
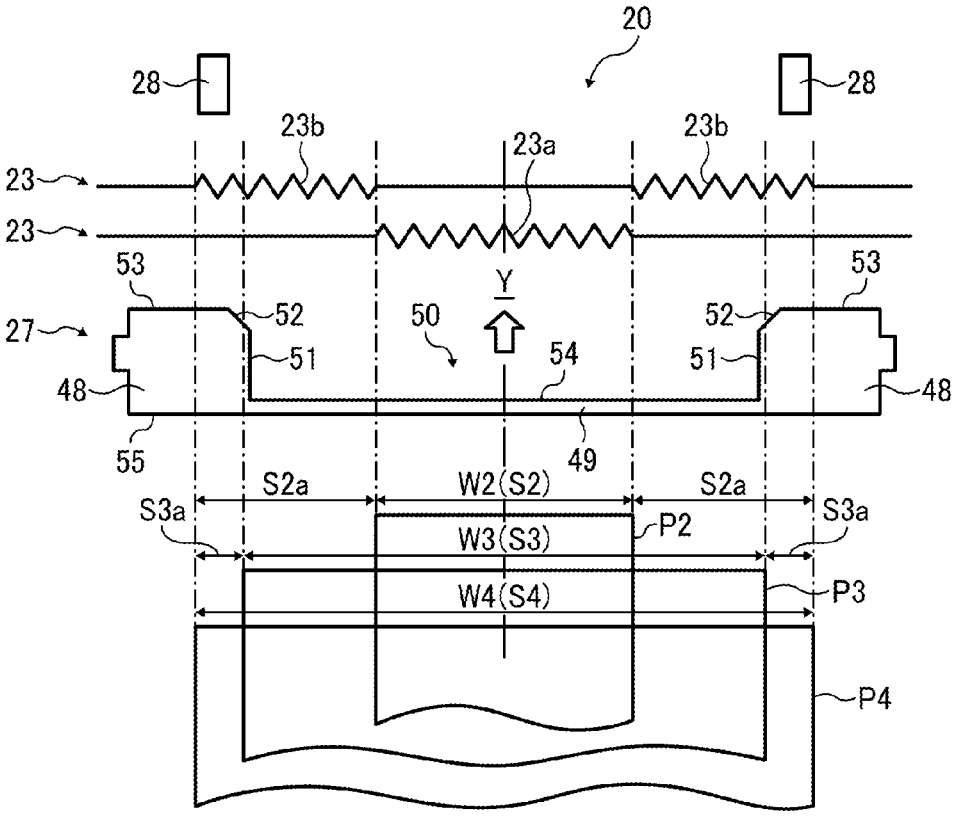
FIG. 8 is a schematic diagram of the fixing device shown in FIG. 4 illustrating a halogen heater pair incorporated therein, the heat shield, and the sizes of recording media.

With reference to FIG. 8, a description is provided of a relation between the shape of the heat shield 27, heat generators of the halogen heater pair 23, and the sizes of recording media.

FIG. 8 is a schematic diagram of the fixing device 20 illustrating the halogen heater pair 23, the heat shield 27, and the sizes of recording media.

First, a detailed description is given of the shape of the heat shield 27.

It is to be noted that an axial direction of the heat shield 27 defines a direction in which an axis of the heat shield 27 extends in the axial direction of the fixing belt 21. A circumferential direction of the heat shield 27 defines a direction in which the heat shield 27 rotates in the circumferential direction of the fixing belt 21.

As shown in FIG. 8, the heat shield 27 includes a pair of shield portions 48 constituting both lateral ends of the heat shield 27 in the axial direction thereof, respectively; a bridge 49 bridging the shield portions 48 in the axial direction of the heat shield 27; and a recess 50 defined by the shield portions 48 and the bridge 49, and in turn itself defining an inboard edge of each shield portion 48. The pair of shield portions 48 is provided at both end portions of the heat shield 27 in the axial direction of the heat shield 27. The recess 50 between the pair of shield portions 48 in the axial direction of the heat shield 27 does not shield the fixing belt 21 from the halogen heater pair 23 and therefore allows light radiated from the halogen heater pair 23 to irradiate the fixing belt 21.

Each shield portion 48 includes an axially straight edge 53 constituting one end of the shield portion 48 in the circumferential direction of the heat shield 27 and extending in the axial direction thereof. The axially straight edge 53 extends substantially throughout the entire width of the shield portion 48 in the axial direction of the heat shield 27 except for a sloped edge 52, a detailed description of which is deferred. The axially straight edge 53 of the shield portion 48 is provided downstream from the inner edge 54 of the bridge 49 in the rotation direction R3 of the fixing belt 21 depicted in FIG. 2. For example, the shield portions 48 are provided downstream from the bridge 49 in a shield direction Y, equivalent to the rotation direction R3 of the fixing belt 21, in which the heat shield 27 rotates and moves to the shield position shown in FIG. 2. The inner edge 54 of the bridge 49 is connected to the axially straight edge 53 of one shield portion 48 through the inboard edge of the shield portion 48 that is provided opposite the inboard edge of another shield portion 48. The inboard edge of the shield portion 48 includes a circumferentially straight edge 51 extending parallel to the circumferential direction of the heat shield 27 in which the heat shield 27 rotates and the sloped edge 52 angled relative to the circumferentially straight edge 51.

As shown in FIG. 8, the sloped edge 52 is contiguous to the circumferentially straight edge 51 substantially in the shield direction Y. The sloped edge 52 is angled outboard from the circumferentially straight edge 51 substantially in the shield direction Y such that an interval between the sloped edge 52 and another sloped edge 52 increases. Accordingly, the recess 50 has a uniform, decreased width defined by the circumferentially straight edges 51 in the axial direction of the heat shield 27 and an increased width defined by the sloped edges 52 in the axial direction of the heat shield 27 that increases gradually in the shield direction Y. An outer edge 55 of the heat shield 27 provided at another end of the heat shield 27 in the circumferential direction thereof and defining an outer edge of the bridge 49 and the shield portions 48 extends straight in the axial direction of the heat shield 27.

Next, a detailed description is given of a relation between the heat generators of the halogen heater pair 23 and the sizes of recording media.

As shown in FIG. 8, the halogen heater pair 23 has multiple heat generators having different lengths in the axial direction of the fixing belt 21 and being disposed at different positions in the axial direction of the fixing belt 21 to heat different axial spans on the fixing belt 21 according to the size of the recording medium P. For example, the halogen heater pair 23 is constructed of the lower halogen heater 23 having a center heat generator 23*a* disposed opposite a center of the fixing belt 21 in the axial direction thereof and the upper halogen heater 23 having lateral end heat generators 23*b* disposed opposite both lateral ends of the fixing belt 21 in the axial direction thereof, respectively. The center heat generator 23*a* spans a conveyance span S2 corresponding to a width W2 of a medium recording medium P2 in the axial direction of the fixing belt 21. Conversely, the lateral end heat generators 23*b*, together with the center heat generator 23*a*, span a conveyance span S3 corresponding to a width W3 of a large recording medium P3 greater than the width W2 of the medium recording medium P2 and a conveyance span S4 corresponding to a width W4 of an extra-large recording medium P4 greater than the width W3 of the large recording medium P3.

A detailed description is now given of a relation between the shape of the heat shield 27 and the sizes of the recording media P2, P3, and P4.

Each circumferentially straight edge 51 is provided inboard from and in proximity to an edge of the conveyance span S3 corresponding to the width W3 of the large recording medium P3 in the axial direction of the fixing belt 21. According to the present embodiment, each sloped edge 52 overlaps the edge of the conveyance span S3 corresponding to the width W3 of the large recording medium P3 as the standard size recording medium in the axial direction of the fixing belt 21.

For example, the medium recording medium P2 is a letter size recording medium having a width W2 of 215.9 mm or an A4 size recording medium having a width W2 of 210 mm. The large recording medium P3 is a double letter size recording medium having a width W3 of 279.4 mm or an A3 size recording medium having a width W3 of 297 mm. The extra-large recording medium P4 is an A3 extension size recording medium having a width W4 of 329 mm. However, examples of the sizes of recording media are not limited to those described above. Additionally, the medium, large, and extra-large sizes mentioned herein are relative terms. Hence, an actual width of each recording medium are not limited to those described above.

With reference to FIG. 2, a description is provided of a fixing operation of the fixing device 20 described above.

As the image forming apparatus 1 depicted in FIG. 1 is powered on, the power supply supplies power to the halogen heater pair 23 and at the same time the driver drives and rotates the pressing roller 22 clockwise in FIG. 2 in the rotation direction R4. Accordingly, the fixing belt 21 rotates counterclockwise in FIG. 2 in the rotation direction R3 in accordance with rotation of the pressing roller 22 by friction between the pressing roller 22 and the fixing belt 21.

A recording medium P bearing a toner image T formed by the image forming operation of the image forming apparatus 1 described above is conveyed in the recording medium conveyance direction A1 while guided by a guide plate and enters the fixing nip N formed between the fixing belt 21 and the pressing roller 22 pressed against the fixing belt 21. The fixing belt 21 heated by the halogen heater pair 23 heats the recording medium P and at the same time the pressing roller 22 pressed against the fixing belt 21, together with the fixing belt 21, exerts pressure on the recording medium P, thus fixing the toner image T on the recording medium P.

The recording medium P bearing the fixed toner image T is discharged from the fixing nip N in a recording medium conveyance direction A2. As a leading edge of the recording medium P comes into contact with a front edge of a separator, the separator separates the recording medium P from the fixing belt 21. Thereafter, the separated recording medium P is discharged by the output roller pair 13 depicted in FIG. 1 onto the outside of the image forming apparatus 1, that is, the output tray 14 where the recording medium P is stocked.

With reference to FIG. 8, a description is provided of control of the halogen heater pair 23 and the heat shield 27 according to the sizes of recording media.

As the medium recording medium P2 is conveyed over the fixing belt 21 depicted in FIG. 8, the controller 90 depicted in FIG. 3 turns on the center heat generator 23*a* to heat the conveyance span S2 of the fixing belt 21 corresponding to the width W2 of the medium recording medium P2. As the extra-large recording medium P4 is conveyed over the fixing belt 21, the controller 90 turns on the lateral end heat generators 23*b* as well as the center heat generator 23*a* to heat the conveyance span S4 of the fixing belt 21 corresponding to the width W4 of the extra-large recording medium P4.

However, as described above, the halogen heater pair 23 is configured to heat the conveyance span S2 corresponding to the width W2 of the medium recording medium P2 and the conveyance span S4 corresponding to the width W4 of the extra-large recording medium P4. Accordingly, if the center heat generator 23*a* is turned on as the large recording medium P3 is conveyed over the fixing belt 21, the center heat generator 23*a* does not heat each outboard span S2*a* outboard from the conveyance span S2 in the axial direction of the fixing belt 21. Consequently, the large recording medium P3 is not heated throughout the entire width W3 thereof. Conversely, if the lateral end heat generators 23*b* are turned on in addition to the center heat generator 23*a*, the lateral end heat generators 23*b* and the center heat generator 23*a* heat the conveyance span S4 greater than the conveyance span S3 corresponding to the width W3 of the large recording medium P3. If the large recording medium P3 is conveyed over the fixing belt 21 while the lateral end heat generators 23*b* and the center heat generator 23*a* are turned on, the lateral end heat generators 23*b* may heat both outboard spans S3*a* outboard from the conveyance span S3 corresponding to the width W3 of the large recording medium P3, resulting in overheating of the fixing belt 21 in the outboard spans S3*a*.

Figure 9:
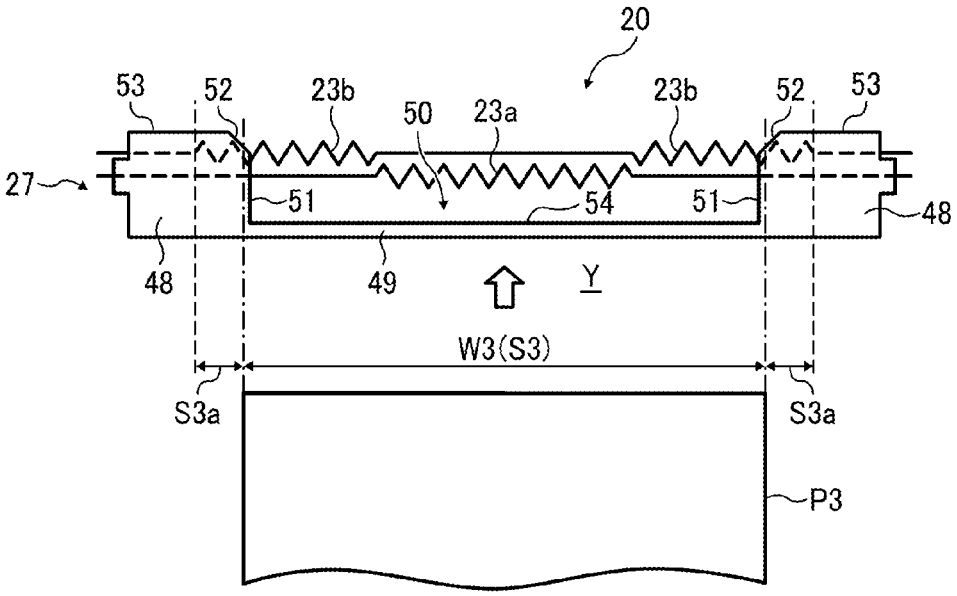
FIG. 9 is a schematic diagram of the fixing device shown in FIG. 2 illustrating the heat shield at the shield position.

To address this circumstance, as the large recording medium P3 is conveyed over the fixing belt 21, the heat shield 27 moves to the shield position as shown in FIG. 9. FIG. 9 is a schematic diagram of the fixing device 20. At the shield position shown in FIG. 9, the shield portions 48 of the heat shield 27 shield the fixing belt 21 in a region in proximity to both side edges of the large recording medium P3 and the outboard spans S3*a*, thus suppressing overheating of the fixing belt 21 in the outboard spans S3*a* where the large recording medium P3 is not conveyed.

When a fixing job is finished or the temperature of the outboard span S3*a* of the fixing belt 21 where the large recording medium P3 is not conveyed decreases to a predetermined threshold and therefore the heat shield 27 is no longer requested to shield the fixing belt 21, the controller 90 moves the heat shield 27 to the retracted position shown in FIG. 4. Thus, the fixing device 20 performs the fixing job precisely by moving the heat shield 27 to the shield position shown in FIG. 2 at a proper time without decreasing the rotation speed of the fixing belt 21 and the pressing roller 22 to convey the large recording medium P3.

Since each shield portion 48 includes the sloped edge 52, as a rotation position of the heat shield 27 changes, the shield portions 48 can adjust the range in which the lateral end heat generators 23*b* are overlapped. For example, as the number of recording media or the period of time for the recording media to pass through the fixing nip N formed between the fixing belt 21 and the pressing roller 22 increases, the temperature of the fixing belt 21 in the non-conveyance span tends to increase. Therefore, when the number of recording media comes to a predetermined number or when the period of time for the recording media passing through the fixing nip N reaches a predetermined period of time, the controller 90 moves the heat shield 27 to rotate in a direction in which the heat shield 27 covers the lateral end heat generators 23*b* disposed opposite both lateral ends of the fixing belt 21 in the axial direction thereof. Consequently, the heat shield 27 is less exposed to light radiated from the halogen heater pair 23 and therefore the fixing belt 21 is less susceptible to abnormal overheating.

The temperature sensor 28 for detecting the temperature of the fixing belt 21 is disposed opposite an axial span on the fixing belt 21 where the fixing belt 21 is subject to overheating.

According to the present embodiment, as shown in FIG. 8, the temperature sensor 28 is disposed opposite each outboard span S3*a* outboard from the conveyance span S3 corresponding to the width W3 of the large recording medium P3 because the fixing belt 21 is subject to overheating in the outboard span S3*a*. Since the fixing belt 21 is substantially subject to overheating by the lateral end heat generators 23*b* of the halogen heater pair 23, the temperature sensors 28 are disposed opposite the lateral end heat generators 23*b* of the halogen heater pair 23, respectively.

Figure 10:
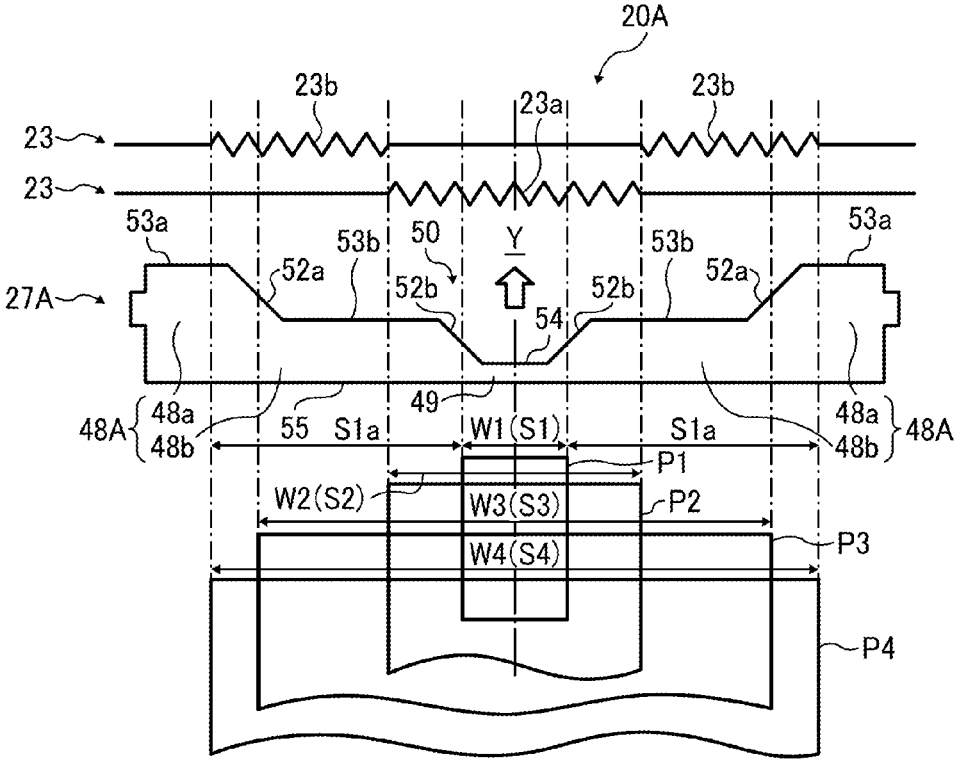
FIG. 10 is a schematic diagram of a fixing device according to another embodiment.
Figure 11:
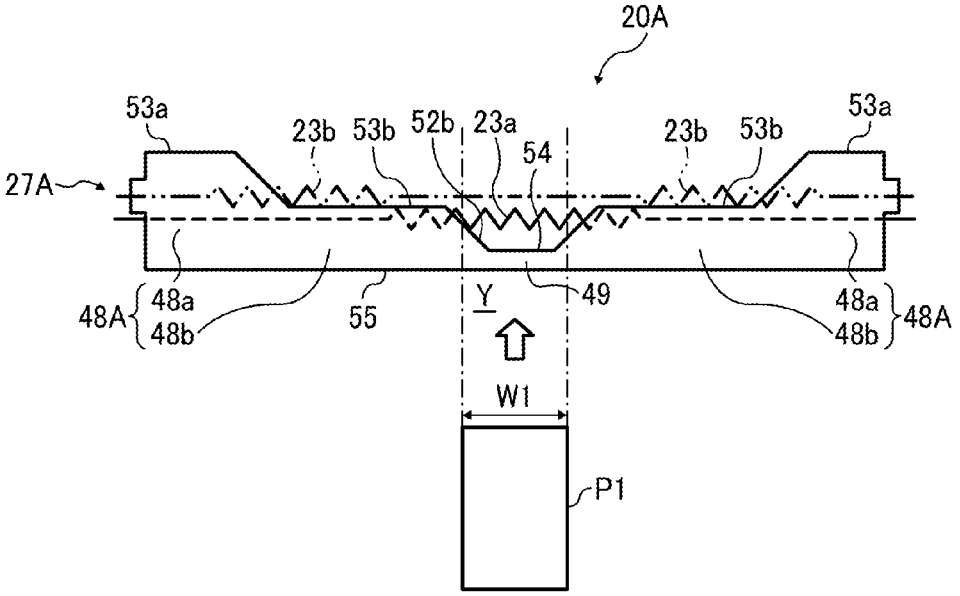
FIG. 11 is a schematic diagram of the fixing device shown in FIG. 10 illustrating the heat shield at the shield position.

With reference to FIGS. 10 and 11, a description is provided of a configuration of a fixing device 20A incorporating a heat shield 27A according to another embodiment.

FIG. 10 is a schematic diagram of the fixing device 20A. FIG. 11 is a partial schematic diagram of the fixing device 20A. As shown in FIG. 10, the heat shield 27A integrally includes a pair of shield portions 48A provided at both lateral ends of the heat shield 27A in an axial direction thereof, respectively. Each of the shield portions 48A has two steps. Each shield portion 48A includes a small shield section 48*a* having a decreased length in a longitudinal direction of the heat shield 27A parallel to the axial direction thereof and a large shield section 48*b* having an increased length in the longitudinal direction of the heat shield 27A. The bridge 49 bridges the large shield section 48*b* of one shield portion 48A provided at one lateral end of the heat shield 27A and the large shield section 48*b* of another shield portion 48A provided at another lateral end of the heat shield 27A in the axial direction thereof. The small shield section 48*a* is contiguous to and outboard from the large shield section 48*b* in the axial direction of the heat shield 27A. An axially straight edge 53*a* provided at one end of the small shield section 48*a* in a circumferential direction of the heat shield 27A, that is, the rotation direction R3 of the fixing belt 21, is provided downstream from an axially straight edge 53*b* provided at one end of the large shield section 48*b* in the circumferential direction of the heat shield 27A in the shield direction Y. The axially straight edge 53*b* is provided downstream from the inner edge 54 of the bridge 49 in the shield direction Y. A sloped edge 52*a*, that is, an inboard edge of one small shield section 48*a* in the axial direction of the heat shield 27A is provided opposite another sloped edge 52*a*, that is, an inboard edge of another small shield section 48*a* in the axial direction of the heat shield 27A. Similarly, a sloped edge 52*b*, that is, an inboard edge of one large shield section 48*b* in the axial direction of the heat shield 27S is provided opposite another sloped edge 52*b*, that is, an inboard edge of another large shield section 48*b* in the axial direction of the heat shield 27A. That is, the sloped edges 52*a* and 52*b* constitute an inboard edge of the shield portion 48A in the axial direction of the heat shield 27A. The recess 50 between the pair of shield portions 48A in the axial direction of the heat shield 27A is defined and enclosed by the sloped edge 52*a* of each small shield section 48*a*, the axially straight edge 53*b* and the sloped edge 52*b* of each large shield section 48*b*, and the inner edge 54 of the bridge 49. The pair of shield portions 48A of the heat shield 27A does not include a circumferentially straight edge that is similar to the circumferentially straight edge 51 extending parallel to the circumferential direction of the heat shield 27 shown in FIG. 8.

As illustrated in FIG. 10, at least four sizes of recording media P including a small recording medium P1, a medium recording medium P2, a large recording medium P3, and an extra-large recording medium P4 are available in the fixing device 20A. For example, the small recording medium P1 includes a postcard having a width of 100 mm. The medium recording medium P2 includes an A4 size recording medium having a width of 210 mm. The large recording medium P3 includes an A3 size recording medium having a width of 297 mm. The extra-large recording medium P4 includes an A3 extension size recording medium having a width of 329 mm. However, the small recording medium P1, the medium recording medium P2, the large recording medium P3, and the extra-large recording medium P4 may include recording media of other sizes.

A width W1 of the small recording medium P1 is smaller than the length of the center heat generator 23*a* in the longitudinal direction of the halogen heater pair 23 parallel to the axial direction of the heat shield 27A. The sloped edge 52*b* of the large shield section 48*b* overlaps a side edge of the width W1 of the small recording medium P1. The sloped edge 52*a* of the small shield section 48*a* overlaps a side edge of the width W3 of the large recording medium P3. It is to be noted that a description of the relation between the position of recording media other than the small recording medium P1, that is, the medium recording medium P2, the large recording medium P3, and the extra-large recording medium P4, and the position of the center heat generator 23*a* and the lateral end heat generators 23*b* of the fixing device 20A is omitted because it is similar to that of the fixing device 20 described above.

As the small recording medium P1 is conveyed through the fixing nip N, the center heat generator 23*a* is turned on.

However, since the center heat generator 23*a* heats the conveyance span S2 on the fixing belt 21 corresponding to the width W2 of the medium recording medium P2 that is greater than the width W1 of the small recording medium P1, the controller 90 moves the heat shield 27A to the shield position shown in FIG. 11. At the shield position, each large shield section 48*b* of the heat shield 27S shields the fixing belt 21 from the center heat generator 23*a* in an outboard span S1*a* outboard from a conveyance span S1 corresponding to the width W1 of the small recording medium P1 in the axial direction of the fixing belt 21. Accordingly, the fixing belt 21 does not overheat in each outboard span S1*a* where the small recording medium P1 is not conveyed over the fixing belt 21.

It is to be noted that, as the medium recording medium P2, the large recording medium P3, and the extra-large recording medium P4 are conveyed through the fixing nip N, the controller 90 performs a control for controlling the halogen heater pair 23 and the heat shield 27A that is similar to the control for controlling the halogen heater pair 23 and the heat shield 27 described above. In this case, each small shield section 48*a* of the heat shield 27A shields the fixing belt 21 from the halogen heater pair 23 as each shield portion 48 of the fixing device 20 does.

As shown in FIG. 10, like the shield portion 48 of the fixing device 20 that has the sloped edge 52, the small shield section 48*a* and the large shield section 48*b* have the sloped edges 52*a* and 52*b*, respectively. Accordingly, by changing the rotation angled position of the heat shield 27A, the controller 90 changes the span on the fixing belt 21 shielded from the center heat generator 23*a* and the lateral end heat generators 23*b* of the halogen heater pair 23 by the small shield section 48*a* and the large shield section 48*b* of each shield portion 48A.

As shown in FIGS. 2 and 4, the fixing belt 21 includes the heat shield 27 therein to move the heat shield 27 between the shield position and the retracted position. When the heat shield 27 is located at the shield position, a part of light or heat radiated from the halogen heater pair 23 is reflected by the shield portion 48 of the heat shield 27 and is returned to the reflector 26. Reflection of heat returned form the reflector 26 may cause the reflected heat to travel between the heat shield 27 and the reflector 26. Therefore, the reflector 26 is heated, resulting in an increase in the temperature of the reflector 26. Alternatively, since heat applied to the reflector 26 comes away from to the reflector 26 to the stay 25, the heat capacity of the reflector 26 and the structure around the reflector 26 increases. Consequent to the above-described factors, the amount of loss of energy of the fixing device 20 increases.

To address this circumstance, descriptions are given of configurations fixing devices 20B and 20C having heat shields 27B and 27C, respectively.

Figure 12:
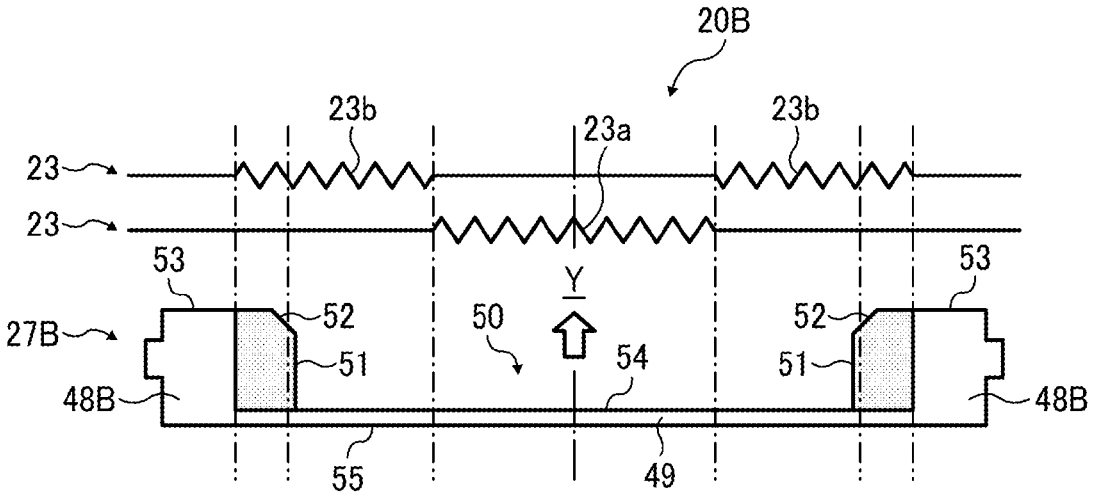
FIG. 12 is a schematic diagram of a fixing device according to yet another embodiment illustrating a halogen heater pair and a heat shield incorporated therein.

With reference to FIG. 12, a detailed description is given of the configuration of the fixing device 20B having the heat shield 27B according to another embodiment.

As illustrated in FIG. 12, heat reflectance of at least a dotted area on the surface of each shield portion 48 where a heat shield 27B faces the halogen heater pair 23 is set to a value smaller than heat reflectance on a surface of the reflector 26 opposite and facing the halogen heater pair 23.

Accordingly, even when the heat shield 27B is located at the shield position, the amount of heat absorbed to a shield portion 48B increases. Therefore, heat to be absorbed to the reflector 26 is reduced, so that absorption of heat to the reflector 26 is reduced, and an excessive rise in temperature of the reflector 26 (Specifically, an excessive temperature rise in temperature of the reflector 26 corresponding to the non-conveyance span of the fixing belt 21) and an increase in loss of energy of the fixing device 20B due to a large amount of heat is generated inside the loop formed by the fixing belt 21. In this case, the temperature of the shield portion 48B increases. However, the shield portion 48B is disposed between the halogen heater pair 23 and the fixing belt 21, and moreover is disposed close to the inner circumferential surface of the fixing belt 21. Therefore, heat absorbed to the shield portion 48B can heat the fixing belt 21. As a result, the loss of energy from the fixing device 20B can be reduced throughout the entire fixing device 20B.

Whether the shield portion 48B of the heat shield 27B is at the shield position shown in FIG. 2 or at the retracted position shown in FIG. 4, the bridge 49 bridging the shield portions 48B in the axial direction of the heat shield 27 is disposed behind the reflector 26. Therefore, the bridge 49 does not receive light from the halogen heater pair 23 and the reflector 26 directly. Accordingly, heat reflectance reflected by the bridge 49 does not matter. Further, non-dotted areas of the shield portions 48B are disposed opposite the lateral end heat generators 23*b* disposed at both lateral end portions of the halogen heater pair 23. The non-dotted areas facing outboard areas outboard from respective outer end portions of the lateral end heat generators 23*b* receive less amount of light or heat radiated from the lateral end heat generators 23*b*. Therefore, heat reflectance reflected by the non-dotted areas of the shield portions 48B does not matter, either. As a result, a minimum effect can be obtained by specifying heat reflectance in the respective dotted areas of the shield portions 48B shown in FIG. 12 to the above-described relation.

Alternatively, heat reflectance on the entire surface of the heat shield 27B disposed facing the halogen heater pair 23 can be specified to the above-described relation. For example, the reflector 26 may include a film, e.g., a silver-plated film having high heat reflectance to be formed on the surface thereof opposite the halogen heater pair 23 or may include an aluminum electropolished surface as the surface thereof opposite the halogen heater pair 23. In either case, if the entire heat shield 27B is formed by stainless steel, heat reflectance of the heat shield 27B is smaller than heat reflectance of the reflector 26, that is, a relational expression of heat reflectance of the heat shield 27B<heat reflectance of the reflector 26 can be obtained. Accordingly, the heat shield 27B according to the present embodiment can obtain the above-described effect.

Figure 13:
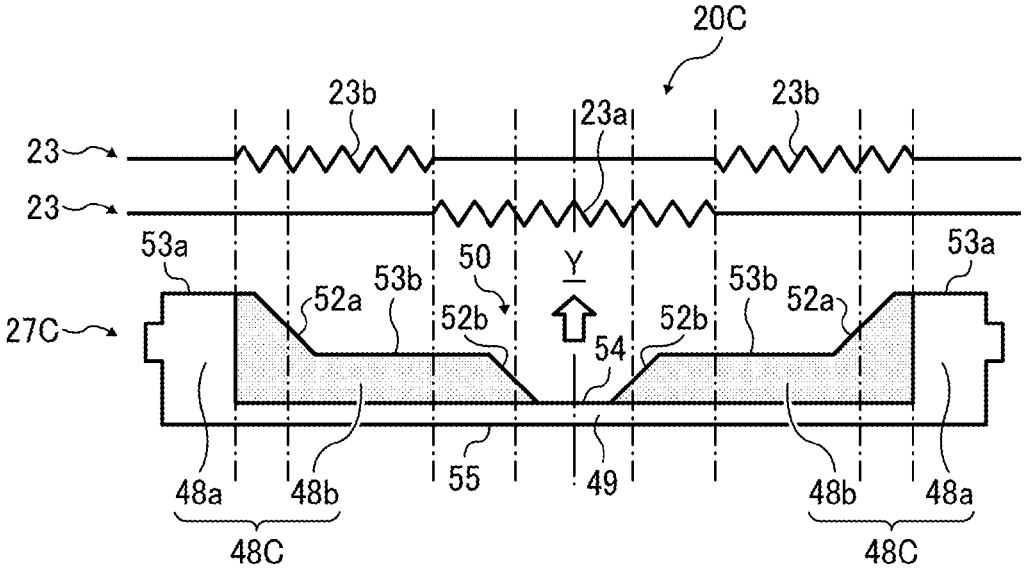
FIG. 13 is a schematic diagram of a fixing device according to yet another embodiment illustrating a halogen heater pair and a heat shield incorporated therein.

With reference to FIG. 13, a detailed description is given of the configuration of the heat shield 27C. The configuration of the heat shield 27C shown in FIG. 13 is based on that of the heat shield 27 shown in FIG. 10 and that of the heat shield 27B shown in FIG. 12.

With the heat shield 27C illustrated in FIG. 13, heat reflectance of at least a dotted area on the surface of each shield portion 48C where the heat shield 27 faces the halogen heater pair 23 is set to a value smaller than heat reflectance on a surface of the reflector 26 facing the halogen heater pair 23. By so doing, the heat shield 27C according to the present embodiment can obtain the same effect as the effect descried above.

Figure 14:
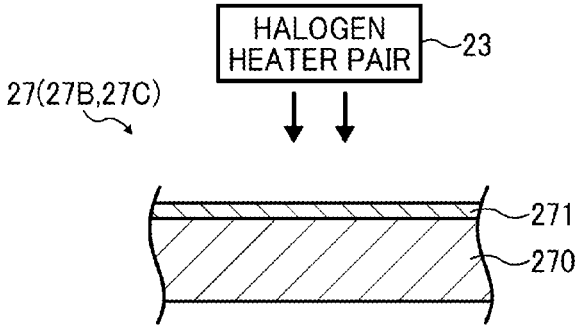
FIG. 14 is a vertical sectional view illustrating the heat shield having a multilayer structure and the halogen heater pair.
Figure 15:
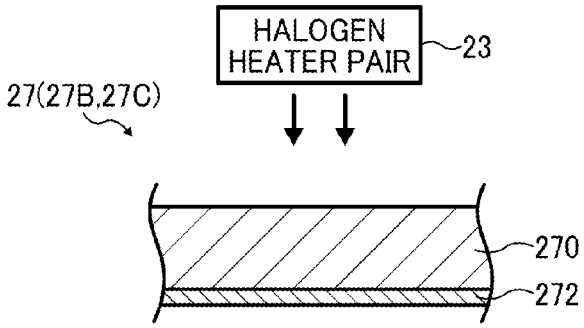
FIG. 15 is a vertical sectional view illustrating the heat shield having another multilayer structure and the halogen heater pair.
Figure 16:
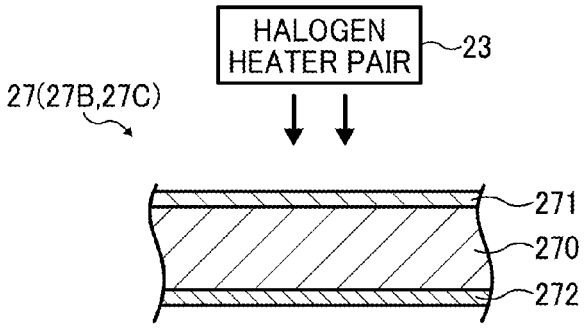
FIG. 16 is a vertical sectional view illustrating the heat shield having yet another multilayer structure and the halogen heater pair.

With reference to FIGS. 14 through 16, descriptions are given of the structures of the heat shields 27B and 27C. Hereinafter, the heat shield 27 refers to the heat shields 27B and 27C in the description with reference to FIGS. 14 through 16. The same is applied to the fixing device 20 (i.e., the fixing devices 20B and 20C) and the shield portions 48 (i.e., the shield portions 48B and 48C). FIG. 14 is a cross-sectional view illustrating the heat shield having a multilayer structure. FIG. 15 is a cross-sectional view illustrating the heat shield having another multilayer structure. FIG. 16 is a cross-sectional view illustrating the heat shield having yet another multilayer structure.

As illustrated in FIG. 14, the heat shield 27 has multiple layers including a base member 270 and a low heat reflectance layer 271 that overlaps the surface of the base member 270. The heat shield 27 is substantially applicable to employ a material having high heat reflectance with low cost or other advantages. In this case, the base member 270 is formed by using such a material and the low heat reflectance layer 271 is formed by using a material having heat reflectance lower than the base member 270. The low heat reflectance layer 271 can use a film formed by a known film formation method such as plating and deposition. The multiple layer of the heat shield 27 shown in FIG. 14 can be obtained by accumulating and combining two types of thin plates.

With this structure of the heat shield 27 shown in FIG. 14, by providing heat reflectance of the low heat reflectance layer 271 smaller than heat reflectance of the reflector 26 disposed opposite the halogen heater pair 23, the heat shield 27 can obtain the above-described effect.

For obtaining the above-described effect, it is not requested that the entire heat shield 27 has a multilayer structure. The above-described effect can be obtained when at least the dotted areas of the shield portions 48 shown in FIGS. 12 and 13, which are disposed opposite the halogen heater pair 23, include multilayer configurations. It is to be noted that examples of the material of the base member 270 are metallic material such as aluminum and steel including stainless steel, ceramic, and the like.

When the heat shield 27 is located at the shield position and is shielded from light radiated from the halogen heater pair 23, the shield portion 48 is heated intensively. Therefore, the temperatures of the shield portions 48 of the heat shield 27 and an area surrounding the shield portions 48 tend to increase locally. Specifically, when heat reflectance of each shield portion 48 is decreased as described above, the tendency of a temperature increase in the shield portions 48 may be encouraged. The increase in temperature of a local portion or local portions of the heat shield 27 is preferably avoided so as not to cause heating non-uniformity, deformation of the heat shield 27, and the like.

To address this circumstance, it can be considered to increase thermal conductivity of the heat shield 27. An increase in thermal conductivity of the heat shield 27 can disperse heat absorbed to the shield portions 48 locally to the entire heat shield 27 promptly. Accordingly, an excessive increase in temperature of local portions of the heat shield 27 can be prevented.

The multilayer structure of the heat shield 27 illustrated in FIG. 15 is designed to achieve the above-described effect. As illustrated in FIG. 15, the heat shield 27 has multiple layers including the base member 270 and a high thermal conductivity layer 272 that overlaps the surface of the base member 270. In this case, the thermal conductivity of the high thermal conductivity layer 272 is greater than at least the thermal conductivity of the base member 270. More particularly, the high thermal conductivity layer 272 is formed by using a material having a thermal conductivity of 30 W/(m·K) or greater at room temperature, and preferably a thermal conductivity of 80 W/(m·K) or greater at room temperature. Examples of the material are copper, aluminum, and nickel. It is to be noted that the high thermal conductivity layer 272 may be formed using a film or a thin plate, which is similar to the low heat reflectance layer 271.

The high thermal conductivity layer 272 is formed throughout one of a surface of the base member 270 facing the halogen heater pair 23 and another surface of the base member 270 opposite the facing surface thereof. As an example, the high thermal conductivity layer 272 illustrated in FIG. 15 is formed on another surface of the base member 270 opposite the surface facing the halogen heater pair 23. In this case, the surface of the base member 270 facing the halogen heater pair 23 is requested to have heat reflectance that is smaller than that on the surface opposite the halogen heater pair 23 of the reflector 60.

In a case in which the base member 270 having the above-described heat reflectance cannot be used, the heat shield 27 having the multilayer structure as illustrated in FIG. 16 is employed. That is, the multilayer structure of the heat shield 27 shown in FIG. 16 includes the base member 270, the low heat reflectance layer 271 on the surface thereof provided facing the halogen heater pair 23, and the high thermal conductivity layer 272 on the opposite surface thereof. Specifically, the base member 270 is sandwiched by or interposed between the low heat reflectance layer 271 and the high thermal conductivity layer 272. With this structure, the excessive temperature rise in temperature of the reflector 26 and an increase in loss of energy of the fixing device 20 due to a large amount of heat are prevented. Accordingly, the loss of energy of the fixing device 20 can be reduced.

In FIGS. 14 through 16, the heat shield 27 is constructed of two or more layers. It is preferable that the heat shield 27 has a predetermined heat reflectance of 30 W/(m·K) or greater. It is more preferable that the heat shield 27 has a predetermined heat reflectance of 30 W/(m·K) or greater and a predetermined thermal resistance of 350 degrees Celsius or greater. As long as the heat shield 27 includes a material that meets the above-described conditions (such as copper, aluminum, and nickel), the heat shield 27 may be formed with the material in a single layer.

In addition, to address the above-described circumstance about the increase in the amount of loss of energy of the fixing device 20, further descriptions are given of configurations fixing devices 20D and 20E having heat shields 27D and 27E, respectively.

Figure 17:
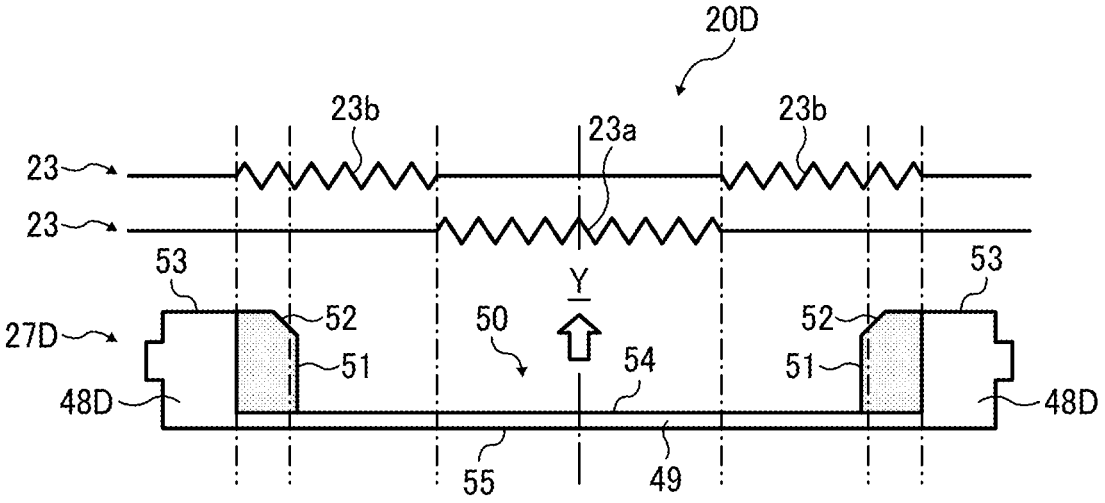
FIG. 17 is a schematic diagram of a fixing device according to yet another embodiment illustrating a halogen heater pair and a heat shield incorporated therein.

With reference to FIG. 17, a detailed description is given of the configuration of the fixing device 20D having the heat shield 27D according to yet another embodiment.

As illustrated in FIG. 17, heat absorptance of at least a dotted area on the surface of each shield portion 48 where a heat shield 27D faces the halogen heater pair 23 is set to a value greater than heat absorptance on a surface of the reflector 26 facing the halogen heater pair 23. The amount of heat absorptance in the present embodiment is determined based on heat absorptance included by a material that forms the surface of each member to be compared. Heat absorptance may be varied according to gloss and color of the surface of the material. For example, at least the dotted area on the surface of each shield portion 48 where the heat shield 27*d* faces the halogen heater pair 23 is a black, non-glossy surface. By contrast, the surface of the reflector 26 facing the halogen heater pair 23 includes a glossy surface. With these approaches, the shield portions 48 and the reflector 26 can be controlled to have different the amounts of heat absorptance thereon easily. As another approach to change the color of the surface of each material, a film of colored heat-resistant resin can be provided on the surface of the material, for example.

Accordingly, even when the heat shield 27D is located at the shield position, the amount of heat absorbed to a shield portion 48D increases. Therefore, heat to be absorbed to the reflector 26 is reduced, so that absorption of heat to the reflector 26 is reduced, and an excessive rise in temperature of the reflector 26 (Specifically, an excessive temperature rise in temperature of the reflector 26 corresponding to the non-conveyance span of the fixing belt 21) and an increase in loss of energy of the fixing device 20D due to a large amount of heat is generated inside the loop formed by the fixing belt 21. In this case, the temperature of the shield portion 48D increases. However, the shield portion 48D is disposed between the halogen heater pair 23 and the fixing belt 21, and moreover is disposed close to the inner circumferential surface of the fixing belt 21. Therefore, heat absorbed to the shield portion 48D can heat the fixing belt 21. As a result, the loss of energy from the fixing device 20D can be reduced throughout the entire fixing device 20D.

Whether the shield portion 48B of the heat shield 27D is at the shield position shown in FIG. 2 or at the retracted position shown in FIG. 4, the bridge 49 bridging the shield portions 48D in the axial direction of the heat shield 27 is disposed behind the reflector 26. Therefore, the bridge 49 does not receive light from the halogen heater pair 23 and the reflector 26 directly. Accordingly, heat absorptance absorbed by the bridge 49 does not matter. Further, non-dotted areas of the shield portions 48D are disposed opposite the lateral end heat generators 23*b* disposed at both lateral end portions of the halogen heater pair 23. The non-dotted areas facing outboard areas outboard from respective outer end portions of the lateral end heat generators 23*b* receive less amount of light or heat radiated from the lateral end heat generators 23*b*. Therefore, heat absorption absorbed by the non-dotted areas of the shield portions 48D does not matter, either. As a result, a minimum effect can be obtained by specifying heat absorptance in the respective dotted areas of the shield portions 48D shown in FIG. 17 to the above-described relation.

Alternatively, heat absorptance on the entire surface of the heat shield 27D disposed facing the halogen heater pair 23 can be specified to the above-described relation. For example, the reflector 26 may include a film, e.g., a silver-plated film having high heat reflectance to be formed on the surface thereof opposite the halogen heater pair 23 or may include an aluminum electropolished surface as the surface thereof opposite the halogen heater pair 23. In either case, if the entire surface of the heat shield 27D is formed by a black-colored film of heat-resistant resin or if the entire heat shield 27D is formed by stainless steel, heat absorption of the heat shield 27D is greater than heat absorption of the reflector 26, that is, a relational expression of heat absorptance of the heat shield 27D>heat absorptance of the reflector 26 can be obtained. Accordingly, the heat shield 27D according to the present embodiment can obtain the above-described effect.

Figure 18:
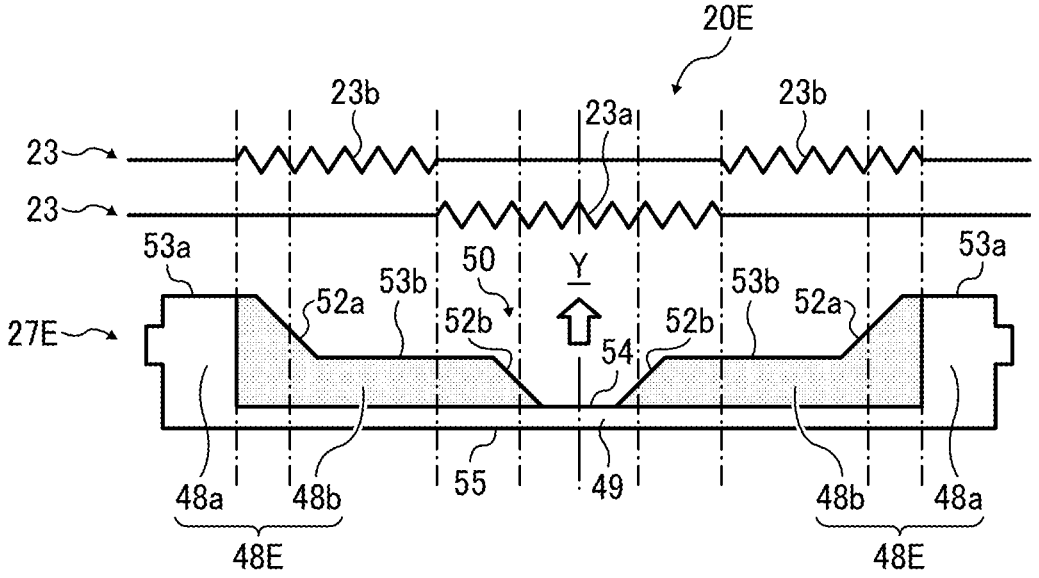
FIG. 18 is a schematic diagram of a fixing device according to yet another embodiment illustrating a halogen heater pair and a heat shield incorporated therein.

With reference to FIG. 18, a detailed description is given of the configuration of the heat shield 27E. The configuration of the heat shield 27E shown in FIG. 18 is based on that of the heat shield 27 shown in FIG. 10 and that of the heat shield 27D shown in FIG. 17.

With the heat shield 27E illustrated in FIG. 18, heat absorptance of at least a dotted area on the surface of each shield portion 48E where the heat shield 27 faces the halogen heater pair 23 is set to a value greater than heat absorptance on a surface of the reflector 26 facing the halogen heater pair 23. By so doing, the heat shield 27E according to the present embodiment can obtain the same effect as the effect descried above.

Figure 19:
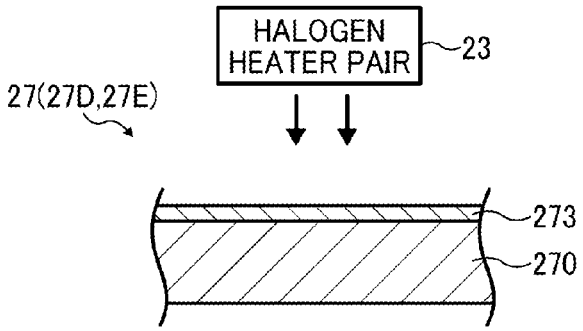
FIG. 19 is a vertical sectional view illustrating the heat shield having a multilayer structure and the halogen heater pair.
Figure 20:
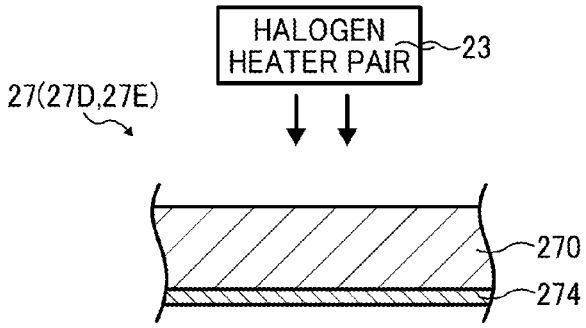
FIG. 20 is a vertical sectional view illustrating the heat shield having another multilayer structure and the halogen heater pair.
Figure 21:
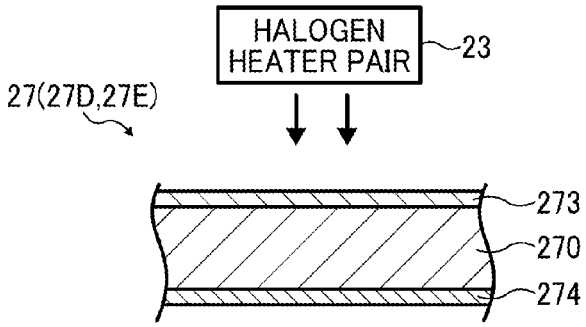
FIG. 21 is a vertical sectional view illustrating the heat shield having yet another multilayer structure and the halogen heater pair.

With reference to FIGS. 19 through 21, descriptions are given of the structures of the heat shields 27D and 27E. Hereinafter, the heat shield 27 refers to the heat shields 27D, and 27E in the description with reference to FIGS. 19 through 21. The same is applied to the fixing device 20 (i.e., the fixing devices 20D and 20E) and the shield portions 48 (i.e., the shield portions 48D and 48E). FIG. 19 is a cross-sectional view illustrating the heat shield having a multilayer structure. FIG. 20 is a cross-sectional view illustrating the heat shield having another multilayer structure. FIG. 21 is a cross-sectional view illustrating the heat shield having yet another multilayer structure.

As illustrated in FIG. 19, the heat shield 27 has multiple layers including a base member 270 and a high heat absorptance layer 273 that overlaps the surface of the base member 270. The heat shield 27 is substantially applicable to employ a material having low heat absorptance with low cost or other advantages. In this case, the base member 270 is formed by using such a material and the high heat absorptance layer 273 is formed by using a material having heat absorptance higher than the base member 270. The high heat absorptance layer 273 can use a film formed by a known film formation method such as plating and deposition. The multiple layer of the heat shield 27 shown in FIG. 19 can be obtained by accumulating and combining two types of thin plates.

With this structure of the heat shield 27 shown in FIG. 19, by providing heat absorptance of the high heat absorptance layer 273 greater than heat absorptance of the reflector 26 disposed opposite the halogen heater pair 23, the heat shield 27 can obtain the above-described effect.

For obtaining the above-described effect, it is not requested that the entire heat shield 27 has a multilayer structure. The above-described effect can be obtained when at least the dotted areas of the shield portions 48 shown in FIGS. 17 and 18, which are disposed opposite the halogen heater pair 23, include multilayer configurations. It is to be noted that examples of the material of the base member 270 are metallic material such as aluminum and steel including stainless steel, ceramic, and the like.

When the heat shield 27 is located at the shield position and is shielded from light radiated from the halogen heater pair 23, the shield portion 48 is heated intensively. Therefore, the temperatures of the shield portions 48 of the heat shield 27 and an area surrounding the shield portions 48 tend to increase locally. Specifically, when heat absorptance of each shield portion 48 is increased as described above, the tendency of a temperature increase in the shield portions 48 may be encouraged. The increase in temperature of a local portion or local portions of the heat shield 27 is preferably avoided so as not to cause heating non-uniformity, deformation of the heat shield 27, and the like.

To address this circumstance, it can be considered to increase thermal conductivity of the heat shield 27. An increase in thermal conductivity of the heat shield 27 can disperse heat absorbed to the shield portions 48 locally to the entire heat shield 27 promptly. Accordingly, an excessive increase in temperature of local portions of the heat shield 27 can be prevented.

The multilayer structure of the heat shield 27 illustrated in FIG. 20 is designed to achieve the above-described effect. As illustrated in FIG. 20, the heat shield 27 has multiple layers including the base member 270 and a high thermal conductivity layer 274 that overlaps the surface of the base member 270. In this case, the thermal conductivity of the high thermal conductivity layer 274 is greater than at least the thermal conductivity of the base member 270. More particularly, the high thermal conductivity layer 274 is formed by using a material having a thermal conductivity of 30 W/(m·K) or greater at room temperature, and preferably a thermal conductivity of 80 W/(m·K) or greater at room temperature. Examples of the material are copper, aluminum, and nickel. It is to be noted that the high thermal conductivity layer 274 may be formed using a film or a thin plate, which is similar to the high heat absorptance layer 273.

The high thermal conductivity layer 274 is formed throughout one of a surface of the base member 270 facing the halogen heater pair 23 and another surface of the base member 270 opposite the facing surface thereof. As an example, the high thermal conductivity layer 274 illustrated in FIG. 20 is formed on another surface of the base member 270 opposite the surface facing the halogen heater pair 23. In this case, the surface of the base member 270 facing the halogen heater pair 23 is requested to have heat absorptance that is greater than that on the surface opposite the halogen heater pair 23 of the reflector 60.

In a case in which the base member 270 having the above-described heat absorptance cannot be used, the heat shield 27 having the multilayer structure as illustrated in FIG. 21 is employed. That is, the multilayer structure of the heat shield 27 shown in FIG. 21 includes the base member 270, the high heat absorptance layer 273 on the surface thereof provided facing the halogen heater pair 23, and the high thermal conductivity layer 274 on the opposite surface thereof. Specifically, the base member 270 is sandwiched by or interposed between the high heat absorptance layer 273 and the high thermal conductivity layer 274. With this structure, the excessive temperature rise in temperature of the reflector 26 and an increase in loss of energy of the fixing device 20 due to a large amount of heat are prevented. Accordingly, the loss of energy of the fixing device 20 can be reduced.

In FIGS. 19 through 21, the heat shield 27 is constructed of two or more layers. It is preferable that the heat shield 27 has a predetermined heat reflectance of 30 W/(m·K) or greater. It is more preferable that the heat shield 27 has a predetermined heat reflectance of 30 W/(m·K) or greater and a predetermined thermal resistance of 350 degrees Celsius or greater. As long a as the heat shield 27 includes a material that meets the above-described as conditions (such as copper, aluminum, and nickel), the heat shield 27 may be formed with the material in a single layer.

In the above-described embodiments, each heat reflectance of the heat shields 27B and 27C and each heat absorptance of the heat shields 27D and 27E are specified to meet a predetermined condition to reduce loss of energy of the fixing device 20 (i.e., the fixing devices 20B through 20E). However, the energy saving of the fixing device 20 can be achieved not only by selecting a material according to its property but also by considering the shape of the reflector 26.

Figure 22A:
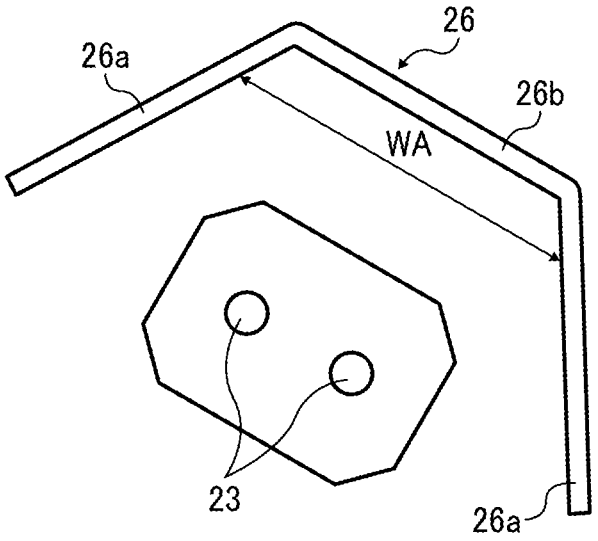
FIGS. 22A and 22B are cross-sectional views illustrating schematic structures of the halogen heater pair and a reflector disposed in the vicinity of the halogen heater pair.
Figure 22B:
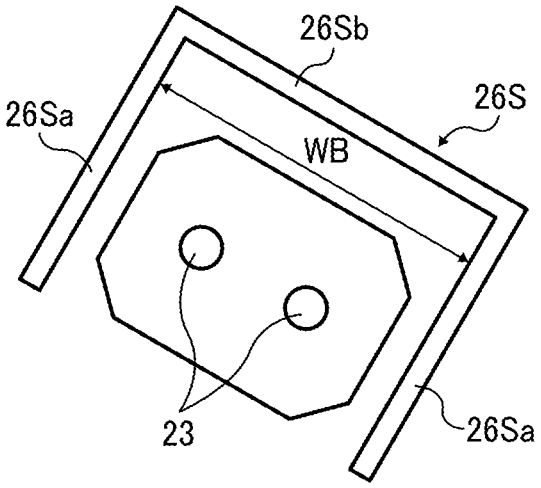

With reference to FIGS. 22A and 22B, descriptions are given of the structures of the halogen heater pair 23 and components around the halogen heater pair 23. FIG. 22A is a cross-sectional view illustrating a schematic structure of the halogen heater pair 23 and the reflector 26. FIG. 22B is a cross-sectional view illustrating a schematic structure of the halogen heater pair 23 and a comparative reflector 26S.

As illustrated in FIG. 22A, the reflector 26 is disposed close to and substantially surrounding the halogen heater pair 23. The reflector 26 includes a center wall 26*b* and sidewalls 26*a* extended from both end portions of the center wall 26*b*. The sidewalls 26*a* stand facing each other and define a width WA therebetween. The sidewalls 26*a* are angled outboard from both end portions of the center wall 26*b* toward the respective tips of the sidewalls 26*a*. Accordingly, the width WA increases toward the respective tips of the sidewalls 26*a*.

By contrast, as illustrated in FIG. 22B, the comparative reflector 26S is disposed close to and substantially surrounding the halogen heater pair 23. The comparative reflector 26S includes a center wall 26Sb and sidewalls 26Sa extended from both end portions of the center wall 26Sb. The sidewalls 26Sa stand facing each other and define a width WB therebetween. The sidewalls 265*a* are angled at a right angle toward the respective tips of the sidewalls 26Sa. Accordingly, the width WB remains the same from the fixed end portions of the center wall 26Sb to the respective tips of the sidewalls 26Sa. When the width WB remains the same to the tips of the sidewalls 26Sa, which corresponds to both end portions of the reflector 26S, heat can be stored in space between the halogen heater pair 23 and the reflector 26S easily. This storage of heat can contribute to an excessive temperature rise in temperature of the reflector 26 and a large amount of heat generated inside the loop formed by the fixing belt 21.

By contrast, the structure of the reflector 26 shown in FIG. 22A can facilitate dispersion of heat from the reflector 26. Therefore, the rise in temperature of the reflector 26 and the loss of energy of the fixing device 20 can be prevented.

As illustrated in FIG. 2, an increase in a local portion of a gap 29 provided between the reflector 26 and the stay 25 hinders transmission of heat from the reflector 26 to the stay 25. As a result, the loss of energy of the fixing device 20 can be reduced further.

According to the present embodiment, the fixing device 20 includes the fixing belt 21. Alternative to the fixing belt 21, the fixing device 20 may include a hollow (cylindrical) fixing roller or a solid fixing roller.

In addition, the shape of the heat shield 27 (including the heat shields 27A through 27E) is not limited to the shape described above. Further, the heat shield 27 may include three or more steps according to the sizes of recording media P available in the image forming apparatus 1.

Further, the configuration of the image forming apparatus 1 incorporating the above-described fixing device 20 is not limited to a printer as illustrated in FIG. 1. Alternatively, a copier, a facsimile machine, or a multifunctional device including the features of the copier and the facsimile machine may be applicable as an image forming apparatus.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A fixing device comprising:

a fixing rotary body rotatable in a predetermined direction of rotation;

a heater disposed opposite and heating the fixing rotary body;

an opposed body contacting the fixing rotary body to form a nip therebetween through which a recording medium is conveyed;

a reflector disposed opposite the heater; and a heat shield disposed between the heater and the fixing rotary body and includes a shield portion to shield heat radiated from the heater to the fixing rotary body, wherein heat reflectance of at least a surface of the shield portion where the heat shield faces the heater is set to a value smaller than heat reflectance on a surface of the reflector opposite and facing the heater.

2. The fixing device according to claim 1, wherein the heat shield has at least an area on the surface of the shield portion disposed opposite the heater comprises a base member; and a low heat reflectance layer overlapping a surface of the base member facing the heater and having a heat reflectance smaller than the base member.

3. The fixing device according to claim 1, wherein the heat shield comprises a base member; and a high thermal conductivity layer overlapping a surface of the base member and having thermal conductivity greater than the base member.

4. The fixing device according to claim 1, wherein the heat shield is formed by using a material having a thermal conductivity of 30 W/(m·K) or greater.

5. The fixing device according to claim 1, wherein the fixing rotary body is a cylindrical body and includes the heater, the heat shield, and the reflector inside a loop formed by the fixing belt.

6. The fixing device according to claim 5, wherein the fixing rotary body is an endless fixing belt, wherein the endless fixing belt comprises a nip formation assembly disposed inside the loop and forming a fixing nip between the fixing belt and the opposed body; and a support disposed inside the loop and contacting and supporting the nip formation assembly.

7. An image forming apparatus comprising the fixing device according to claim 1.

8. The fixing device according to claim 1, wherein the shield portion includes two end portions at opposite ends of the heat shield, the two end portions being wider in a circumferential direction of the heat shield than a bridge portion of the heat shield connecting the two end portions.

9. The fixing device according to claim 1, wherein the heat shield is rotatable in a circumferential direction of the heat shield.

10. The fixing device according to claim 1, wherein the heat shield extends axially along a length of the fixing rotary body.

11. A fixing device comprising:

a fixing rotary body rotatable in a predetermined direction of rotation;

a heater disposed opposite the fixing rotary body to heat the fixing rotary body;

an opposed body contacting an outer circumferential surface of the fixing rotary body to form a nip therebetween through which a recording medium is conveyed;

a reflector disposed opposite the heater; and a heat shield disposed between the heater and the fixing rotary body and includes a shield portion to shield heat radiated from the heater to the fixing rotary body, wherein heat absorptance of at least a surface of the shield portion where the heat shield faces the heater is set to a value greater than heat absorptance on a surface of the reflector opposite and facing the heater.

12. The fixing device according to claim 11, wherein the heat shield has at least an area on the surface of the shield portion disposed opposite the heater comprises a base member; and a high heat absorptance layer overlapping a surface of the base member facing the heater and having a heat absorptance greater than the base member.

13. The fixing device according to claim 11, wherein the heat shield comprises a base member; and a high thermal conductivity layer overlapping a surface of the base member and having thermal conductivity greater than the base member.

14. The fixing device according to claim 11, wherein the heat shield is formed by using a material having a thermal conductivity of 30 W/(m·K) or greater.

15. The fixing device according to claim 11, wherein the fixing rotary body is a cylindrical body and includes the heater, the heat shield, and the reflector inside a loop formed by the fixing belt.

16. The fixing device according to claim 15, wherein the fixing rotary body is an endless fixing belt, wherein the endless fixing belt comprises a nip formation assembly disposed inside the loop and forming a fixing nip between the fixing belt and the opposed body; and a support disposed inside the loop and contacting and supporting the nip formation assembly.

17. An image forming apparatus comprising the fixing device according to claim 11.

18. The fixing device according to claim 11, wherein the shield portion includes two end portions at opposite ends of the heat shield, the two end portions being wider in a circumferential direction of the heat shield than a bridge portion of the heat shield connecting the two end portions.

19. The fixing device according to claim 11, wherein the heat shield is rotatable in a circumferential direction of the heat shield.

20. The fixing device according to claim 11, wherein the heat shield extends axially along a length of the fixing rotary body.

* * * * *